US010014624B2

(12) United States Patent
Chun et al.

(10) Patent No.: US 10,014,624 B2
(45) Date of Patent: Jul. 3, 2018

(54) ELECTRIC CONNECTOR

(71) Applicant: Samsung Electronics Co., Ltd., Gyeonggi-do (KR)

(72) Inventors: Woo-Sung Chun, Gyeonggi-do (KR); Seung-Ki Choi, Gyeonggi-do (KR); Ju-Nyun Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 3 days.

(21) Appl. No.: 14/959,300

(22) Filed: Dec. 4, 2015

(65) Prior Publication Data

US 2016/0190736 A1 Jun. 30, 2016

(30) Foreign Application Priority Data

Dec. 24, 2014 (KR) ..... 10-2014-0188743

(51) Int. Cl.

| | |
|---|---|
| ***H01R 13/24*** | (2006.01) |
| ***H01R 11/30*** | (2006.01) |
| ***H01R 13/62*** | (2006.01) |
| *H01R 13/64* | (2006.01) |
| *H01R 107/00* | (2006.01) |

(52) U.S. Cl.

CPC ..... *H01R 13/6205* (2013.01); *H01R 13/64* (2013.01); *H01R 2107/00* (2013.01)

(58) Field of Classification Search

CPC ..... H01R 13/6205; H01R 13/24; H01R 11/30
USPC ..... 439/39, 700, 38, 40, 217, 22, 660
See application file for complete search history.

(56) References Cited

U.S. PATENT DOCUMENTS

| | | | | |
|---|---|---|---|---|
| 5,829,987 | A * | 11/1998 | Fritsch | H01R 13/7037 200/51.09 |
| 7,097,461 | B2 * | 8/2006 | Neidlein | H01R 13/6205 439/39 |
| 7,625,213 | B1 * | 12/2009 | Tse | H01R 13/6205 439/22 |
| 7,775,801 | B2 * | 8/2010 | Shiff | H01R 13/6205 439/39 |
| 8,177,560 | B2 * | 5/2012 | Rohrbach | H01R 13/6205 439/39 |
| 8,187,006 | B2 * | 5/2012 | Rudisill | H01R 11/30 362/249.06 |
| 8,241,043 | B1 * | 8/2012 | Lin | H01R 13/6205 439/39 |
| 8,514,042 | B2 * | 8/2013 | Lauder | G06F 1/1647 24/303 |
| 8,888,500 | B2 * | 11/2014 | Gao | H01R 13/17 439/39 |
| 9,209,547 | B2 * | 12/2015 | Lozano Villarreal | H01R 13/2421 |
| 9,300,081 | B2 * | 3/2016 | Rudisill | H01R 13/6205 |
| 9,437,968 | B2 * | 9/2016 | Tada | H01R 13/6205 |
| 9,437,969 | B2 * | 9/2016 | Witter | H01R 13/6205 |
| 2007/0161262 | A1 * | 7/2007 | Lloyd | H01R 13/6205 439/39 |
| 2010/0035441 | A1 | 2/2010 | Rohrbach et al. | |

(Continued)

*Primary Examiner* — Michael A Lyons
*Assistant Examiner* — Matthew T Dzierzynski
(74) *Attorney, Agent, or Firm* — Cha & Reiter, LLC.

(57) ABSTRACT

A connector may include a plurality of contacts electrically connected to a mating connector and separated from one another. At least one of the contacts may include a magnet, and a conductive housing for surrounding at least one side of the magnet.

20 Claims, 25 Drawing Sheets

(56) References Cited

U.S. PATENT DOCUMENTS

| | | | | |
|---|---|---|---|---|
| 2014/0273546 | A1* | 9/2014 | Harmon | H01R 13/6205 439/39 |
| 2015/0194764 | A1* | 7/2015 | Magana | H01R 13/6205 439/39 |
| 2016/0285198 | A1* | 9/2016 | Zhou | H01R 13/6205 |

* cited by examiner

ELECTRIC CONNECTOR

CLAIM OF PRIORITY

The present application is related to and claims benefit under 35 U.S.C. § 119(a) to a Korean Application Serial No. 10-2014-0188743, which was filed in the Korean Intellectual Property Office on Dec. 24, 2014, the entire disclosure of which is hereby incorporated by reference.

TECHNICAL FIELD

The present disclosure relates to an electric connector.

BACKGROUND

Based on growth of electronic communications industry, various electronic devices are mass produced. While a design of an electronic device varies depending on its usage, an electronic device typically can indicate an assembly which electrically connects and organically drives a plurality of electronic parts.

The electronic parts in the electronic device are interconnected in various fashions. Mostly, a connector is widely used to facilitate the connections between the electronic parts. Such a connector is not limited to the electronic device and is also used to interconnect an electronic device and another electronic device.

In the related art, two connectors can be connected incorrectly and thus the electronic device is subject to malfunction.

The above information is presented as background information only to assist with an understanding of the present disclosure. No determination has been made, and no assertion is made, as to whether any of the above might be applicable as prior art with regard to the present disclosure.

SUMMARY

To address the above-discussed deficiencies of the prior art, it is a primary aspect of the present disclosure to provide an electric connector for preventing wrong connections between connectors.

Another aspect of the present disclosure is to provide an electric connector system for facilitating connection between connectors.

In accordance with an aspect of the present disclosure, a connector includes a plurality of contacts electrically connected to a mating connector and separated from one another, wherein at least one of the contacts includes a magnet; and a conductive housing for surrounding at least one side of the magnet.

In accordance with another aspect of the disclosure, an electronic device comprises a socket connected to an external plug, wherein the socket comprises, a housing; and a plurality of contacts disposed inside the housing and separated from one another, and at least one of the plurality of contacts comprises a magnet; and a conductive housing for surrounding at least one side of the magnet.

In accordance with another aspect of the disclosure, a connector system comprises: a first connector electrically and detachably connected to a second connector, wherein the first connector comprises, a plurality of first magnets; and a plurality of first conductive contact housings for surrounding respective ones of the plurality of the first magnets, and the second connector comprises, a plurality of second magnets corresponding to the first magnets; and a plurality of second conductive contact housings corresponding to the first conductive contact housings and surrounding at least one side of respective ones of the second magnets.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

For a more complete understanding of the present disclosure and its advantages, reference is now made to the following description taken in conjunction with the accompanying drawings, in which like reference numerals represent like parts.

Throughout the drawings, like reference numerals will be understood to refer to like parts, components and structures.

DETAILED DESCRIPTION

Figure 1:
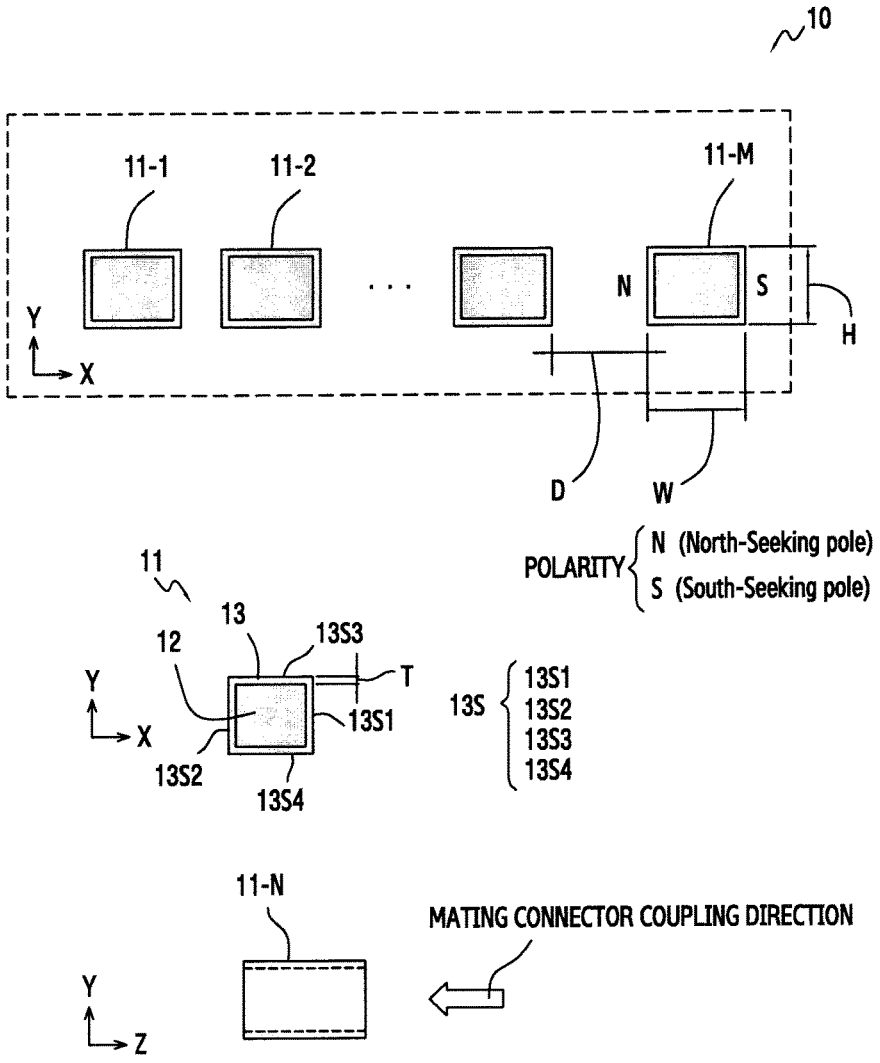
FIG. 1 illustrates a connector according to this disclosure.

FIGS. 1 through 23, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device. The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The expressions "include", "may include", etc. as used in the present disclosure refers to the existence of a corresponding disclosed function, operation or component which may be used in various embodiments of the present disclosure and does not limit one or more additional functions, operations, or components. In the present disclosure, the expressions such as "include", "have", etc. as used in the present disclosure may be construed to denote a certain characteristic, number, step, operation, constituent element, component or a combination thereof, but may not be construed to exclude the existence of or a possibility of addition of one or more other characteristics, numbers, steps, operations, constituent elements, components or combinations thereof. The expression "or", etc. as used in various embodiments of the present disclosure includes any or all of combinations of listed words. For example, the expression "A or B" may include A, may include B, or may include both A and B.

The expression "1", "2", "first", or "second" used in various embodiments of the present disclosure may modify various components of various embodiments but does not limit the corresponding components. For example, the above expressions do not limit the sequence and/or importance of the elements. The above expressions are used merely for the purpose of distinguishing an element from the other elements. For example, a first user device and a second user device indicate different user devices although both of them are user devices. For example, without departing from the scope of the present disclosure, a first component element may be named a second component element. Similarly, the second component element also may be named the first component element.

It should be noted that if it is described that one component element is "coupled" or "connected" to another component element, the first component element may be directly coupled or connected to the second component, and a third component element may be "coupled" or "connected" between the first and second component elements. Conversely, when one component element is "directly coupled" or "directly connected" to another component element, it may be construed that a third component element does not exist between the first component element and the second component element.

The terms in various embodiments of the present disclosure are used to describe various embodiment, and are not intended to limit the present disclosure. As used herein, the singular forms are intended to include the plural forms as well, unless the context clearly indicates otherwise.

Unless defined differently, all terms used herein, which include technical terminologies or scientific terminologies, have the same meaning as a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present disclosure.

An electronic device according to various embodiments of the present disclosure may be a device with a communication function. For example, the electronic device may include at least one of a smart phone, a tablet personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, a wearable device (such as a head-mounted-device (HMD) such as electronic glasses, electronic clothes, an electronic bracelet, an electronic necklace, an electronic appcessory, an electronic tattoo, a smart watch, or the like).

According to various embodiments, the electronic device can be a smart home appliance with a communication function. The smart home appliance as an example of the electronic device may include at least one of, for example, a television, a Digital Video Disk (DVD) player, an audio, a refrigerator, an air conditioner, a vacuum cleaner, an oven, a microwave oven, a washing machine, an air cleaner, a set-top box, a TV box (such as SAMSUNG HOMESYNC™, APPLE TV™, or GOOGLETV™), a game console, an electronic dictionary, an electronic key, a camcorder, and an electronic picture frame.

According to various embodiments, the electronic device includes at least one of various medical appliances (such as Magnetic Resonance Angiography (MRA), Magnetic Resonance Imaging (MRI), Computed Tomography (CT) machine, and an ultrasonic machine), navigation devices, Global Positioning System (GPS) receivers, Event Data Recorders (EDRs), Flight Data Recorders (FDRs), automotive infortainment devices, electronic equipments for ships (such as navigation equipments for ships, gyrocompasses, or the like), avionics, security devices, head units for vehicles, industrial or home robots, Automatic Teller Machines (ATM) of banking facilities, and Point Of Sales (POSs) of shops.

According to various embodiments, the electronic device includes at least one of furniture or a part of a building/structure, an electronic board, an electronic signature receiving device, a projector, and various types of measuring devices (for example, a water meter, an electric meter, a gas meter, a radio wave meter and the like) including a camera function. An electronic device according to various embodiments of the present disclosure is a combination of one or more of above described various devices. Also, an electronic device according to various embodiments of the present disclosure is a flexible device. Also, an electronic device according to various embodiments of the present disclosure is not limited to the above described devices. Hereinafter, an electronic device according to various embodiments will be described with reference to the accompanying drawings. The term "user" used in various embodiments refers to a person who uses an electronic device or a device (for example, an artificial intelligence electronic device) that uses an electronic device.

According to various embodiments, connector(s) and mating connector(s) are presented herein to facilitate connection of a portable terminal and an auxiliary terminal. One of the connector(s) can be disposed on the portable terminal while the other can be disposed on the auxiliary terminal. The connector(s) can include contacts at least one magnet within at least one conductive housing. Magnetic attraction facilitates connection of the connector(s) to the mating connector(s), and accordingly, the portable terminal to the auxiliary terminal.

According to various embodiments presented herein, symmetrical connectors are presented herein that are easily coupled according the correct configuration. The connectors can include contacts that include at least one magnet within at least one conductive housing. The proper configuration can be determined by the magnetic attraction and repulsion of magnets in the connectors. Thus symmetrical connectors that are initially improperly coupled can be rotated with respect to each other to be property coupled.

FIG. 1 illustrates a connector according to this disclosure.

Referring to FIG. 1, a connector 10 may include a plurality of contacts (or connector pins) 11-1 through 11-M. The contacts 11-1 through 11-M may be used for power, data delivery, or grounding. The contacts 11-1 through 11-M may be arranged in one dimension (e.g., in an X-axis direction), and a spacing D between the contacts 11-1 through 11-M may be or not be constant. Although not depicted, the contacts 11-1 through 11-M may be arranged in two dimensions or three dimensions. Herein, a height H (a size in a Y-axis direction) of the contacts 11-1 through 11-M may be or not be constant. A width W (a size in the X-axis direction) of the contacts 11-1 through 11-M may be or not be constant.

Each contact 11-1 . . . 11-M may include a corresponding magnet 12-1 . . . 12-M and a corresponding conductive housing 13-1 . . . 13-M.

The conductive housing 13 may cover at least one side of the magnet 12. The conductive housing 13 may be closed-loop shaped (e.g., a quadrangular tube), and the magnet 12 may be disposed inside the tube of the conductive housing 13. Herein, a thickness T of the conductive housing 13 may be or not be constant.

A contact of a mating connector (not shown) may also include a magnet and a conductive housing surrounding the magnet. When the connector 10 is coupled to the mating connector, at least part of a surface 13S of the conductive housing 13 may contact the conductive housing of the contact of the mating connector. The pole arrangements of the magnets 12-1 . . . 12-M of the contacts 11-1 . . . 11-M of the connector and the magnets of the contacts of the mating connector and the contact may result in attraction of the connector and the mating connector or repulsion of the connector and mating connector. For example, when there is magnetic attraction between a contact of the mating connector and the contact 11-M of the connector 10, the magnetic attraction may pull the contact of the mating connector and the contact 11-M of the connector 10 towards each other. In contrast, when there is magnetic repulsion between the contact of the mating connector and the contact 11-M of the connector 10, the magnetic repulsion may repel the contact of the mating connector and the contact 11-M of the connector 10 away from each other. Herein, the user may recognize that it is hard to couple the two connectors, determine that the two connectors are not coupled correctly, and try to couple the connectors correctly (e.g., rotate the mating connector 180 degrees and then couple it to the connector 10).

Figure 2:
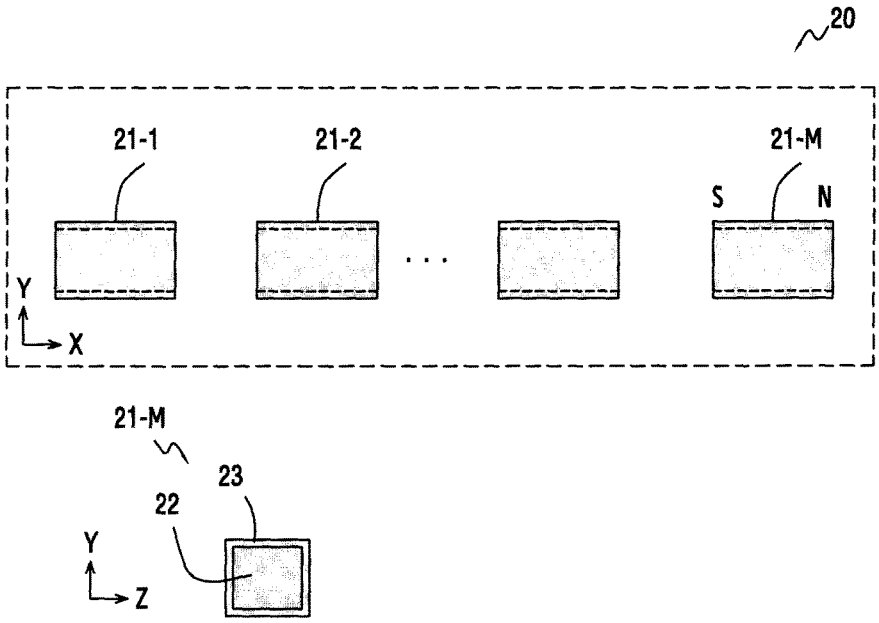
FIG. 2 illustrates another connector according to this disclosure.

FIG. 2 illustrates a connector according to this disclosure depicts an example.

Referring to FIG. 2, a connector 20 may include a plurality of contacts 21-1 through 21-M. Like the contacts 11-1 through 11-M of the connector 10 of FIG. 1, the contacts 21-1 through 21-M may include a magnet 22 and an annular conductive housing 23 surrounding the magnet 22. Notably, each contact 21-M of FIG. 2 may be rotated 180 degrees from the contact 11-M of FIG. 1.

Figure 3A:
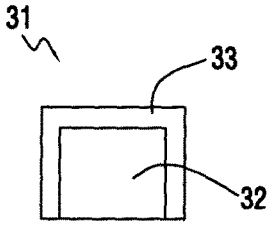
FIG. 3A, FIG. 3B, and FIG. 3C illustrate a contact of a connector according to this disclosure.
Figure 3B:
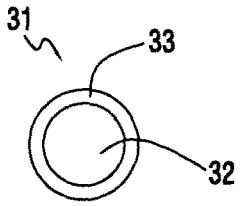
Figure 3C:
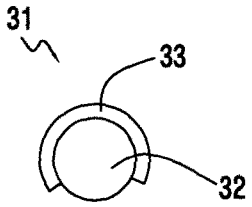

FIGS. 3A, 3B, and 3C illustrate a contact of a connector according to this disclosure.

Referring to FIG. 3A, a contact 31 may include a magnet 32 in a quadrangular sectional shape, and a conductive housing 33 covering part of four surfaces of the magnet 32.

Referring to FIG. 3B, a contact 31 may include a magnet 32 in a circular sectional shape, and an annular conductive housing 33 covering a curved surface of the magnet 32.

Referring to FIG. 3C, a contact 31 may include a magnet 32 in a circular sectional shape, and a conductive housing 33 covering part of a curved surface of the magnet 32.

Figure 4A:
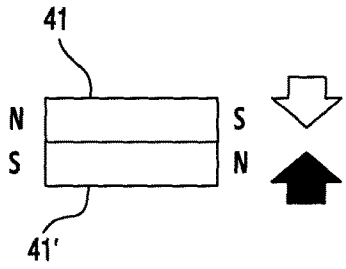
FIG. 4A and FIG. 4B illustrate a connection between two connectors according to this disclosure.
Figure 4B:
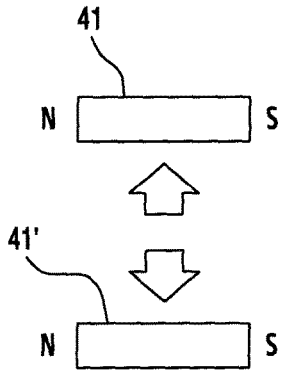

FIGS. 4A and 4B illustrate a connection between two connectors according to this disclosure.

Referring to FIG. 4A, when there is magnetic attraction between a contact 41 of one connector and a contact 41' of the other connector, when the North-seeking pole N of the contact 41 is aligned with the South-seeking pole S of the contact 41', and vice versa, the magnetic attraction may make the two contacts 41 and 41' touch each other (that is, correct coupling of the two connectors).

Referring to FIG. 4B, when there is magnetic repulsion between a contact 41 of one connector and a contact 41' of the other connector, when the North-seeking poles N of each contact 41 and 41' and the South-seeking poles S of each contact 41 and 41' are aligned, the magnetic repulsion may separate the two contacts 41 and 41' from each other (that is, incorrect coupling of the two connectors).

Figure 5A:
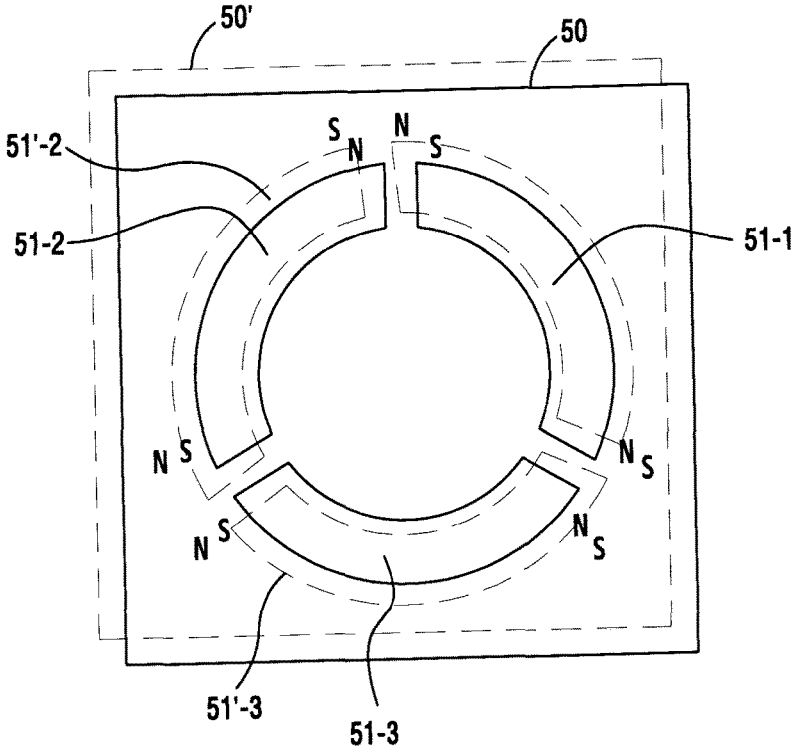
FIG. 5A, FIG. 5B, and FIG. 5C illustrates another connector according to this disclosure.
Figure 5B:
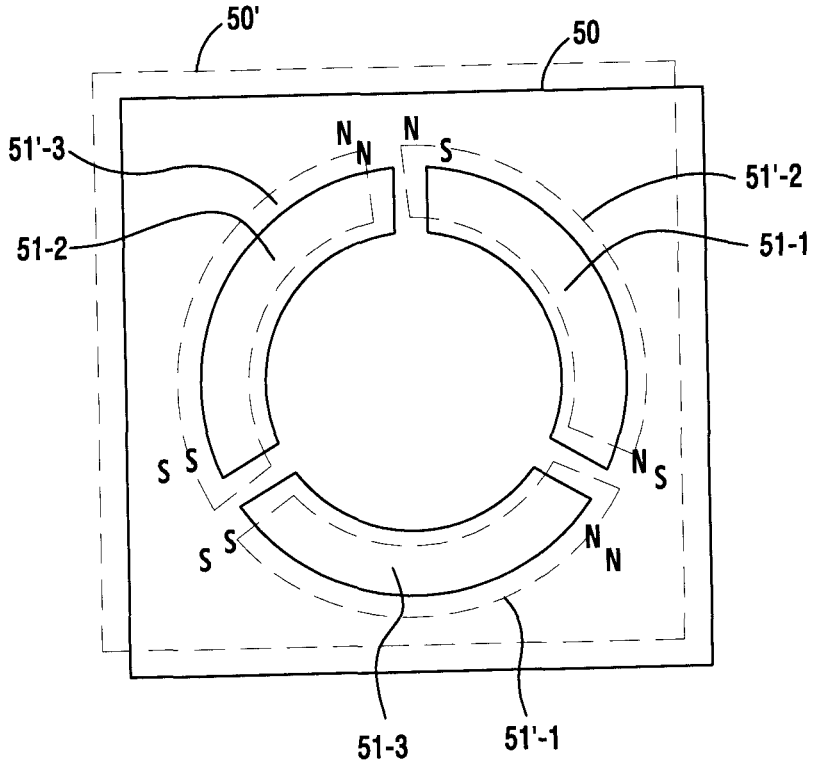
Figure 5C:
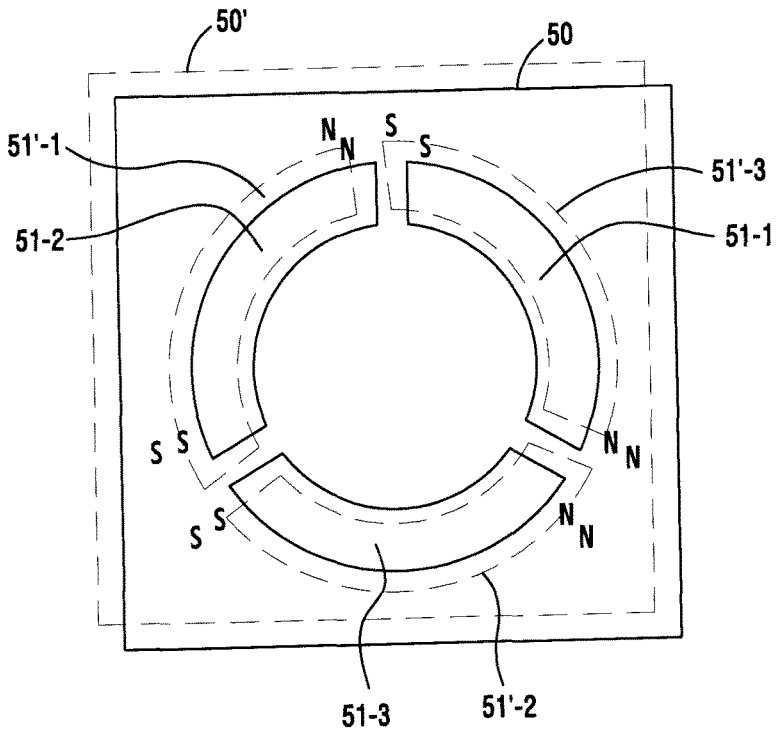

FIG. 5A-5C illustrates connectors according to this disclosure.

Referring to FIG. 5A, a connector 50 may include a plurality of contacts (e.g., three contacts 51-1, 51-2, and 51-3) arranged in a round shape. The contacts 51-1, 51-2, and 51-3 may be arced. Similarly, the contacts 51-1, 51-2, and 51-3 may include a magnet (not shown) and a conductive housing (not shown) surrounding the magnet.

Poles of the contacts 51-1, 51-2, and 51-3 may be arranged irregularly. For example, the pole arrangement of the two contacts 51-1 and 51-2 may be different from the pole arrangement of the contact 51-3. A mating connector 51' may also include a plurality of contacts 51-1', 51-2', 51-3' arranged in a round shape. While the contacts of the mating connector may also include a magnet and a conductive housing surrounding the magnet, they may have the opposite pole arrangement from the connector 50. As shown in FIG. 5A, the mating connector 51' and connector 51 are coupled correctly. However, as will be shown in FIGS. 5B and 5C, when the mating connector and the connector 50 are not coupled correctly, at least one of them generates the magnetic repulsion.

In FIG. 5B, the mating connector 51' is rotated 120 degrees clockwise with respect to the mating connector 51' in FIG. 5A. Note that polarities of the magnets of contacts 51'-1 and 51'-3 cause magnetic repulsion.

In FIG. 5C, the mating connector 51' is rotated 120 degrees clockwise with respect to the mating connector 51' in FIG. 5B. Noted that the polarities of the magnets of each contact 51'-1, 51'-2, 51'-3 cause magnetic repulsion. Additionally, the user may correctly couple the two connectors 51, 51' by rotating the mating connector and creating the magnetic attraction between the two connectors. A skilled artisan will recognize in the improper configuration of FIG. 5C one of the connector(s) can be rotated to result in the proper configuration, such as shown in FIG. 5A. Moreover, unambiguous determination of the correct connection configuration, e.g., FIG. 5A, can occur in certain embodiments by reversing the polarity of one of the magnets, e.g., 51-3, with respect to the other magnets 51-1 and 52-2.

Figure 6A:
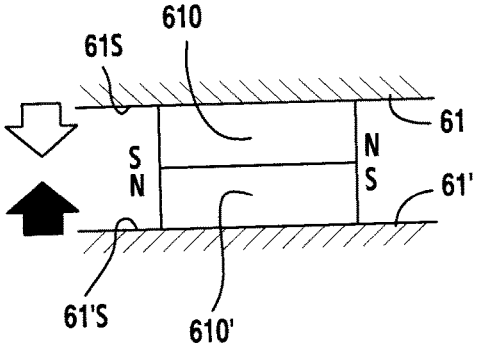
FIG. 6A and FIG. 6B illustrate a connection between electronic parts according to this disclosure.
Figure 6B:
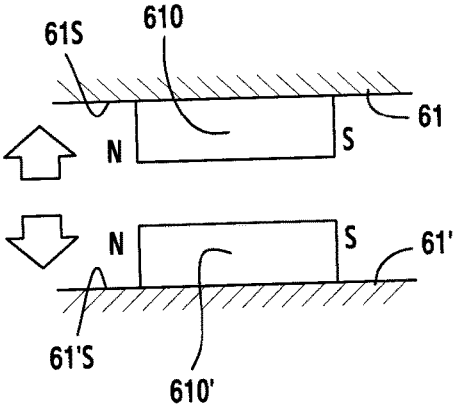

FIGS. 6A and 6B illustrate a connection between electronic parts according to this disclosure. The electronic parts may include a circuit board (e.g., a Printed Circuit Board (PCB) or a Flexible PCB (FPCB)). A first electronic part 61 and a second electronic part 61' may include a first connector 610 and a second connector 610' disposed in facing surfaces 61S and 61'S respectively. Herein, the first connector 610 and the second connector 610' may include one of the connectors of FIGS. 1 through 5.

Referring to FIG. 6A, when there is magnetic attraction between the first connector 610 and the second connector 610', the magnetic attraction may pull the first connector 610 and the second connector 610' toward each other (that is, correct coupling of the two connectors).

Referring to FIG. 6B, when there is magnetic repulsion between the first connector 610 and the second connector 610', the magnetic repulsion may push the first connector 610 and the second connector 610' away from each other (that is, incorrect coupling of the two connectors).

The first connector 610 may be disposed in a side of a portable terminal (not shown). An auxiliary device (e.g., a display, a speaker, a microphone, or a light—not shown) connected to the portable device may include the second connector 610'. When the first connector 610 and the second connector 610' are attracted to each other, the auxiliary device may be attached and electrically connected to the portable terminal. Herein, without a separate mechanic device (e.g., a fitting structure) for holding the auxiliary device and the portable terminal together, the magnetic attraction may easily attach the auxiliary device to the portable terminal. By contrast, when the first connector 610 and the second connector 610' repel each other, the auxiliary device is not attached to the portable device and the user may try to adjust the auxiliary device in a correct coupling direction and attach it to the portable terminal.

Such connector coupling may facilitate a manufacturing process and thus enhance a yield. For example, the first connector 610 may be mounted on a circuit board, and a second connector 610' may be mounted on an electronic part to be connected to the circuit board. When the first connector 610 and the second connector 610' repel each other, the electronic part for the correct coupling may be adjusted and mounted onto the circuit board. In particular, when the electronic part is in a symmetric shape or there is no separate guidance for the correct coupling, it is difficult to correctly mount the electronic part on the circuit board. However, the present connector coupling may address this problem.

Figure 7:
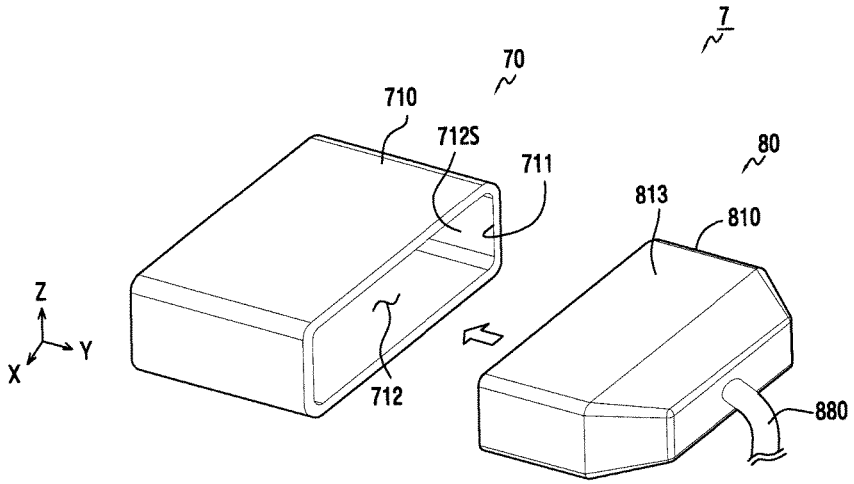
FIG. 7 illustrates an electric connector system according to this present disclosure.

FIG. 7 illustrates an example electric connector system according to this present disclosure.

Referring to FIG. 7, the electric connector system 7 may include a first connector 70 and a second connector 80.

The first connector 70 (e.g., a female connector or a socket) may include a housing 710. The housing 710 may include a receiver 712 including an opening 711. The first connector 70 may be disposed in a PCB, or in a housing or a case frame which forms an exterior of the electronic device. More detailed block diagrams of the first connector will be described in FIGS. 8-10.

The second connector 80 (e.g., a male connector or a plug) may include a housing 810. The housing 810 may include an outer surface 813 fittable into the receiver 712 of the first connector 70. Alternatively, the second connector 80 may further include an electric line 880 (e.g., a cable or an FPCB) extending from the housing 810. More detailed block diagrams of the first connector will be described in FIGS. 10-12.

The housing 810 of the second connector 80 may be inserted into the receiver 712 of the first connector 70 through the opening 711 of the first connector 70. When the second connector 80 is coupled to the first connector 70, a surface 712S of the receiver 712 of the first receiver 710 may guide the movement of the second connector 80 and the outer surface 813 of the second connector 80 may slidingly contact the surface 712S of the receiver 712 of the first connector 70. At least one conductive contact housing (not shown) of the second connector 80 may be electrically contacted with at least one contact housing (not shown) of the first connector 70.

Figure 8:
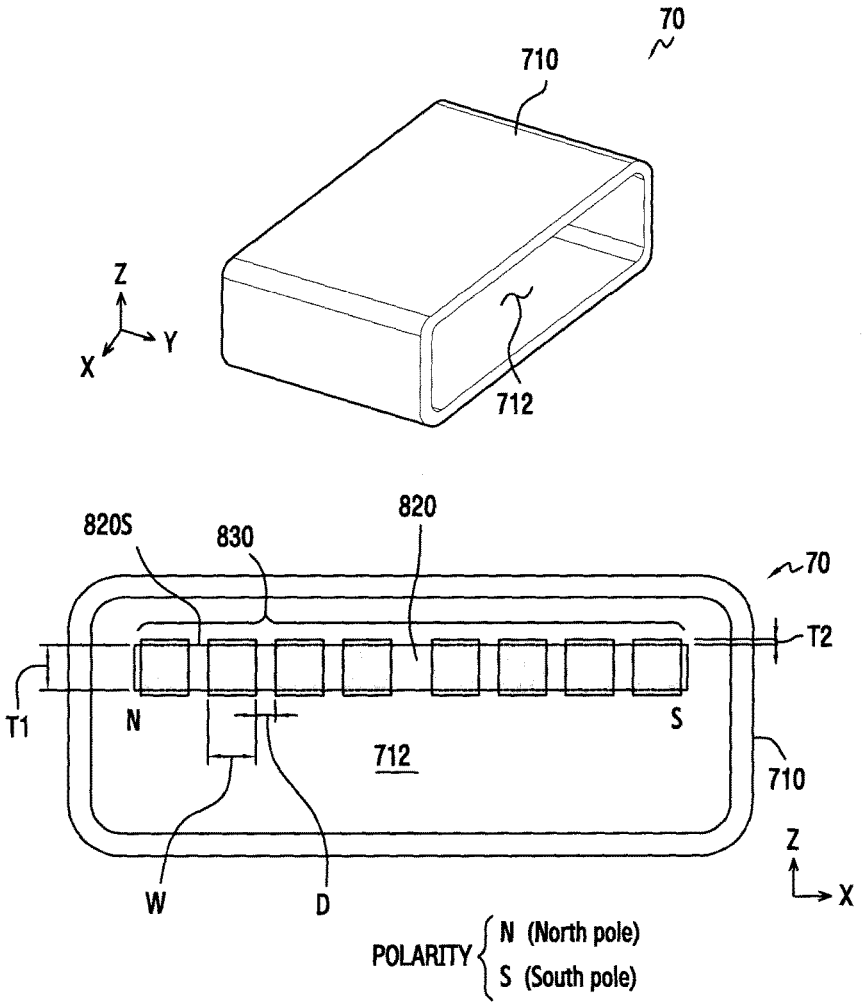
FIG. 8 illustrates a first connector according to this disclosure.

FIG. 8 illustrates an example first connector according to this disclosure.

Referring to FIG. 8, a first connector 70 may include a housing 710, a magnet 820 in a receiver 712 of the housing 710, and a plurality of contact housings 830 surrounding the magnet 820.

The receiver 712 of the housing 710 provides a space for the magnet 820 and the conductive contact housings 830, and the space is alternatively rectangular.

The magnet 820 may be in a bar shape extending in the X-axis direction. Alternatively, although not depicted, the magnet 820 may be in a bar shape extending at an acute angle to the X axis. Alternatively, although not depicted, the magnet 820 may be bent in a shape (e.g., bent at 90 degrees). Alternatively, although not depicted, the magnet 820 may be curved.

A cross section of the magnet 820 may include a circle or a polygon.

A thickness T1 of the magnet 820 may be constant along the X axis. Alternatively, although not depicted, the thickness T1 of the magnet 820 may not be constant along the X axis. Alternatively, although not depicted, a width of the magnet 820 in the Y axis may be or not be constant along the X axis.

A surface 820S of the magnet 820 may include a plate surface or a curved surface. Alternatively, at least part of the surface 820S of the magnet 820 may be or not be flat.

The conductive contact housings 830 may be disposed in the surface 820S of the magnet 820. For example, the conductive contact housings 830 may include a shape (e.g., at least part of a ring shape) surrounding the surface 820S of the magnet 820. The conductive contact housings 830 may be used for the power, the data delivery, or the grounding.

The conductive contact housings 830 may be formed using insert injection on the surface 820S of the magnet 820. Alternatively, the fabricated conductive contact housings 830 may be attached to the surface 820S of the magnet 820.

The conductive contact housings 830 may be arranged in one dimension (e.g., in the X-axis direction). Alternatively, although not depicted, the conductive contact housings 830 may be arranged in two dimensions or in three dimensions.

A spacing D between two neighboring conductive contact housings may be or not be constant. Alternatively, a width W of the conductive contact housings 830 may be or not be constant. Alternatively, a thickness T2 of the conductive contact housings 830 may be or not be constant. In certain embodiments, the polarity of the magnet 820 can be South-seeking along the far end of the x-axis, and North-seeking along the near end of the x-axis.

Figure 9:
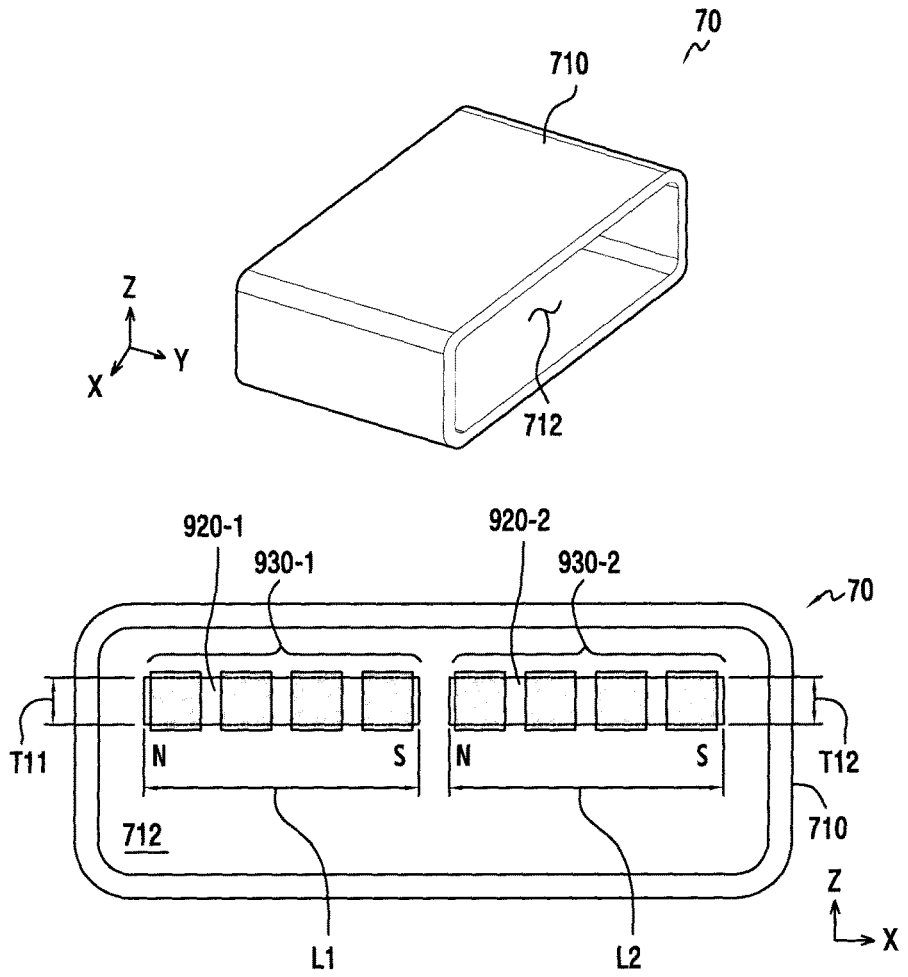
FIG. 9 illustrates a first connector according to this disclosure.

FIG. 9 illustrates another embodiment of the first connector according to this disclosure.

A first connector 70 may include a first magnet 920-1, a second magnet 920-2, a plurality of first conductive contact housings 930-1, and a plurality of second conductive contact housings 930-2, in a receiver 712 of a housing 710.

The first magnet 920-1 may be separated from the second magnet 920-2. For example, the first magnet 920-1 and the second magnet 920-2 may be arranged side by side in a bar shape along the X axis. The first magnet 920-1 and the second magnet 920-2 may have the same pole arrangement. Alternatively, although not depicted, the first magnet 920-1 and the second magnet 920-2 may have the opposite pole arrangement.

A thickness T11 of the first magnet 920-1 may be equal to or different from a thickness T12 of the second magnet 920-2. Alternatively, a length L1 of the first magnet 920-1 may be equal to or different from a length L2 of the second magnet 920-2.

The first conductive contact housings 930-1 may be disposed on the first magnet 920-1. The first conductive contact housings 930-1 may be round shaped. A spacing between two neighboring conductive contact housings of the first conductive contact housings 930-1 may be or not be constant.

The second conductive contact housings 930-2 may be disposed on the second magnet 920-2. The second conductive contact housings 930-2 may be round shaped. A spacing between two neighboring conductive contact housings of the second conductive contact housings 930-2 may be or not be constant.

The shape of the first conductive contact housings 930-1 may be the same as or different from the shape of the second conductive contact housings 930-2.

The number of the first conductive contact housings 930-1 may be equal to or different from the number of the second conductive contact housings 930-2.

Figure 10:
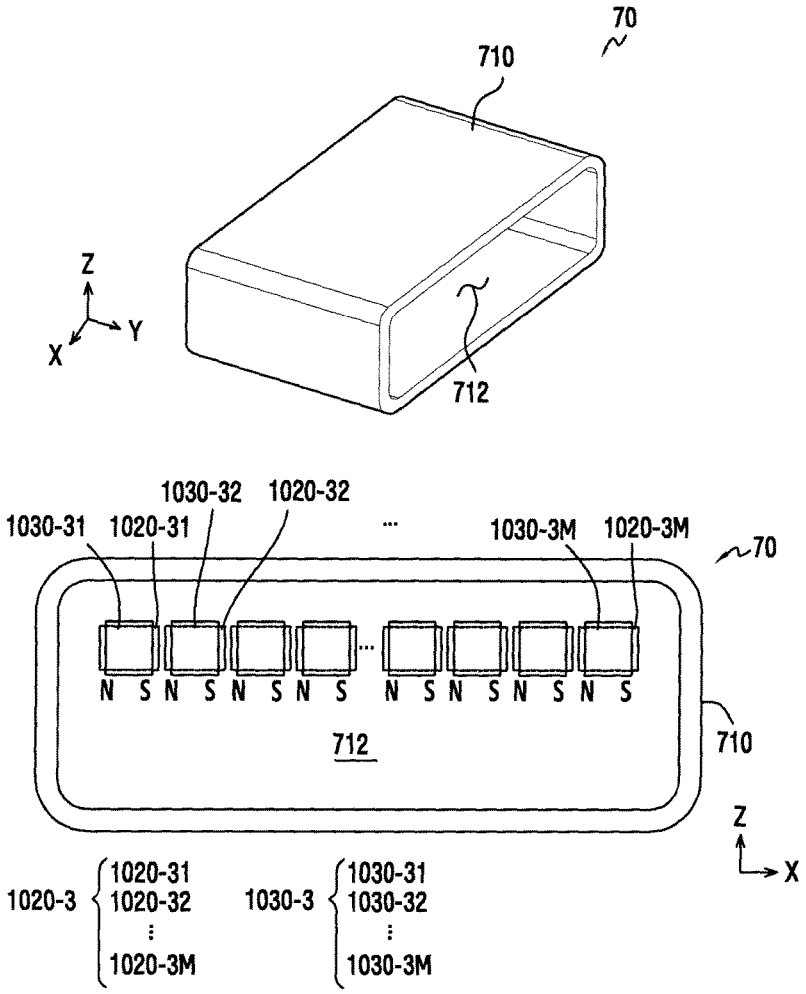
FIG. 10 illustrates a first connector according to this disclosure.

FIG. 10 illustrates another embodiment of the first connector according to this disclosure. A first connector 70 may include a plurality of magnets 1020-3 and a plurality of conductive contact housings 1030-3 in a receiver 712 of a housing 710.

The magnets 1020-3 may be separated individually. For example, the magnets 1020-3 may be arranged in a row along the X axis. A spacing between two neighboring magnets of the magnets 1020-3 may be or not be constant.

The magnets 1020-3 may have the same pole arrangement. Alternatively, although not depicted, at least one of the magnets 1020-3 may have different pole arrangement from the other magnets.

The conductive contact housings 1030-3 may correspond to the magnets 1020-3 one by one. Herein, the conductive contact housings 1030-3 may be in a shape (e.g., a round shape) surrounding at least one side of the magnet 1020-3.

The magnet may be applied to only some (e.g., both ends) of the conductive contact housings 1030-3.

Figure 11:
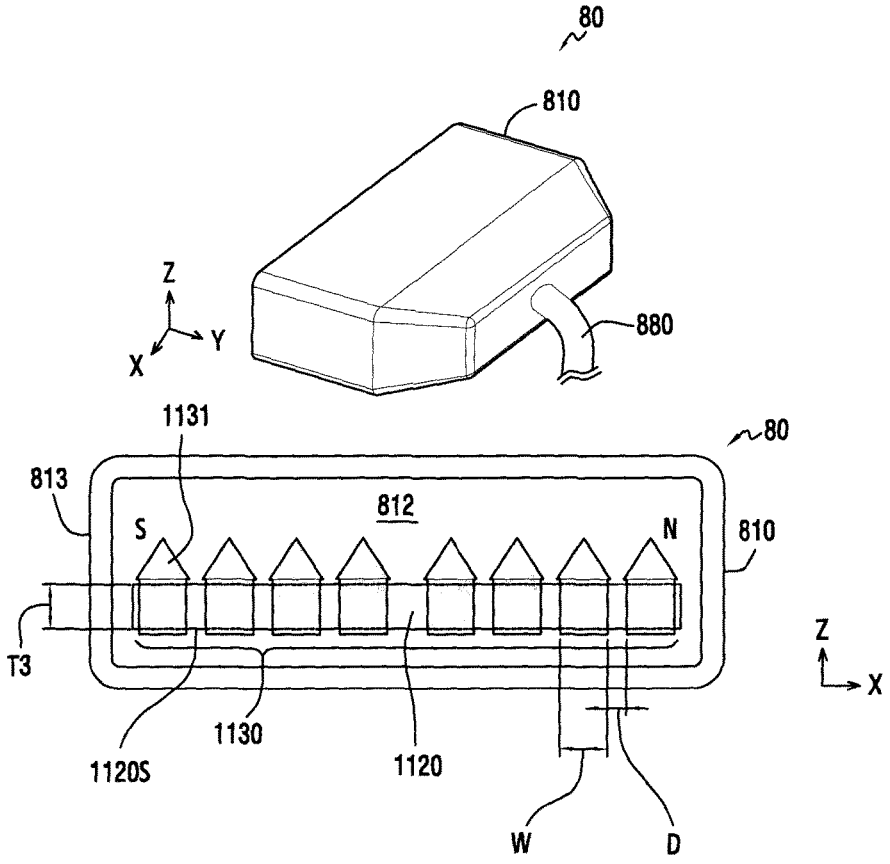
FIG. 11 illustrates a second connector according to this disclosure.

FIG. 11 illustrates an example second connector according to this disclosure.

Referring to FIG. 11, a second connector 80 may include a housing 810, a magnet 1120, and a plurality of conductive contact housings 1130.

The housing 810 may include a receiver 812 and an outer surface 813. The receiver 812 may provide a space for the magnet 1120 and the conductive contact housings 1130. The space of the receiver 812 may be alternatively rectangular. The outer surface 813 may include a shape fitted into the receiver 712 of the first connector 70.

The magnet 1120 may be in a bar shape extending in the X-axis direction. Alternatively, although not depicted, the magnet 1120 may be in a bar shape extending at an acute angle to the X axis. Alternatively, although not depicted, the magnet 1120 may be bent in shape. Alternatively, although not depicted, the magnet 1120 may be curved.

A cross section of the magnet 1120 may include a circle or a polygon.

A thickness T3 of the magnet 1120 may be constant along the X axis. Alternatively, although not depicted, the thickness T3 of the magnet 1120 may not be constant along the X axis. Alternatively, although not depicted, a width of the magnet 1120 in the Y axis may be or not be constant along the X axis. A surface 1120S of the magnet 1120 may include a plate surface or a curved surface. Alternatively, at least part of the surface 1120S of the magnet 1120 may be or not be flat.

The conductive contact housings 1130 may be disposed in the surface 1120S of the magnet 1120. The conductive contact housings 1130 may include a shape surrounding the 1120S of the magnet 1120.

The conductive contact housings 1130 may include an elastic piece 1131. The elastic piece 1131 may elastically contact the conductive contact housing 130 of the first connector 70. For example, although not depicted, the elastic piece 1131 may be formed in the conductive contact housing 830 of the first connector 70, instead of the conductive contact housings 1130 of the second connector 80.

The conductive contact housings 1130 may be formed using the insert injection on the surface 1120S of the magnet 1120. Alternatively, the fabricated conductive contact housings 1130 may be attached to the surface 1120S of the magnet 1120.

The conductive contact housings 1130 may be arranged in one dimension (e.g., in the X-axis direction). Alternatively, although not depicted, the conductive contact housings 1130 may be arranged in two dimensions or in three dimensions.

A spacing D between two neighboring conductive contact housings of the conductive contact housings 1130 may be or not be constant. Alternatively, a width W of the conductive contact housings 1130 may be or not be constant.

In certain embodiments of the present disclosure, an electrical connection system can include a first connector, such as 710, and a second connector, such as 810. Connector 710 can include FIG. 8, while connector 810 can include FIG. 11.

Figure 12:
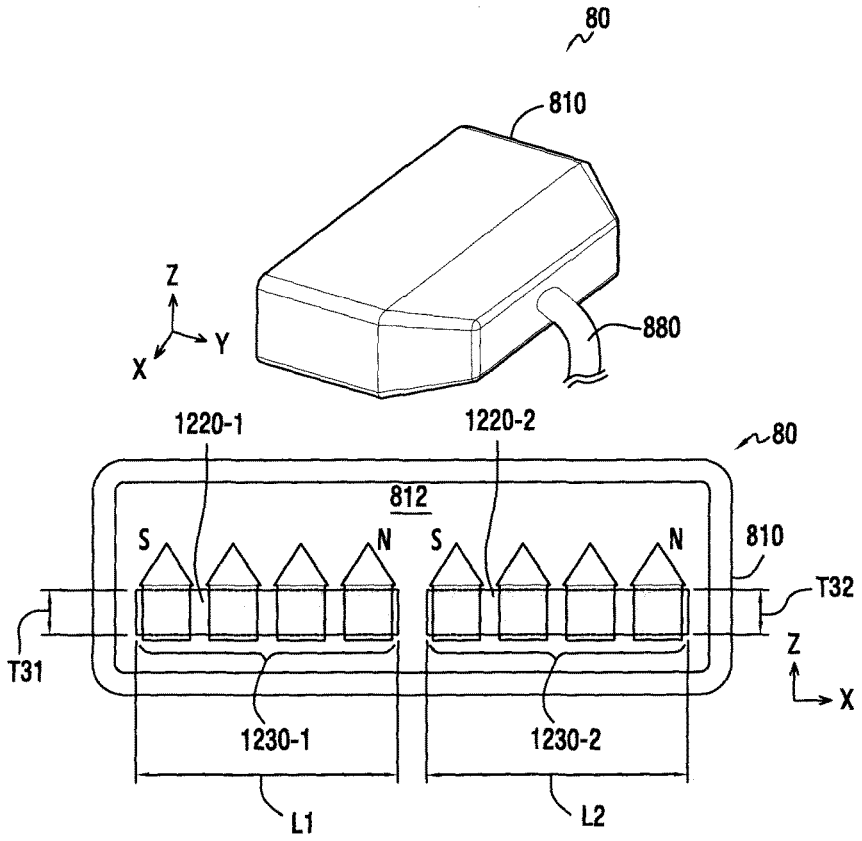
FIG. 12 illustrates a second connector according to this disclosure.

FIG. 12 illustrates an example second connector according to this disclosure.

Referring to FIG. 12, a second connector 80 may include a first magnet 1220-1, a second magnet 1220-2, a plurality of first conductive contact housings 1230-1, and a plurality of second conductive contact housings 1230-2.

The first magnet 1220-1 may be separated from the second magnet 1220-2. For example, the first magnet 1220-1 and the second magnet 1220-2 may be arranged side by side in a bar shape along the X axis.

The first magnet 1220-1 and the second magnet 1220-2 may have the same pole arrangement. Alternatively, although not depicted, the first magnet 1220-1 and the second magnet 1220-2 may have the opposite pole arrangement.

A thickness T31 of the first magnet 1220-1 may be equal to or different from a thickness T32 of the second magnet 1220-2. Alternatively, a length L1 of the first magnet 1220-1 may be equal to or different from a length L2 of the second magnet 1220-2.

The first conductive contact housings 1230-1 may be disposed on the first magnet 1220-1. The first conductive contact housings 1230-1 may be in a round shape surrounding the first magnet 1220-1. A spacing between two neighboring conductive contact housings of the first conductive contact housings 1230-1 may be or not be constant.

The second conductive contact housings 1230-2 may be disposed on the second magnet 1220-2. The second conductive contact housings 1230-2 may be in a round shape surrounding the second magnet 1220-2. A spacing between two neighboring conductive contact housings of the second conductive contact housings 1230-2 may be or not be constant.

The shape of the first conductive contact housings 1230-1 may be the same as or different from the shape of the second conductive contact housings 1230-2.

The number of the first conductive contact housings 1230-1 may be equal to or different from the number of the second conductive contact housings 1230-2.

In certain embodiments of the present disclosure, an electrical connection system can include a first connector, such as 710, and a second connector, such as 810. Connector 710 can include FIG. 9, while connector 810 can include FIG. 12.

Figure 13:
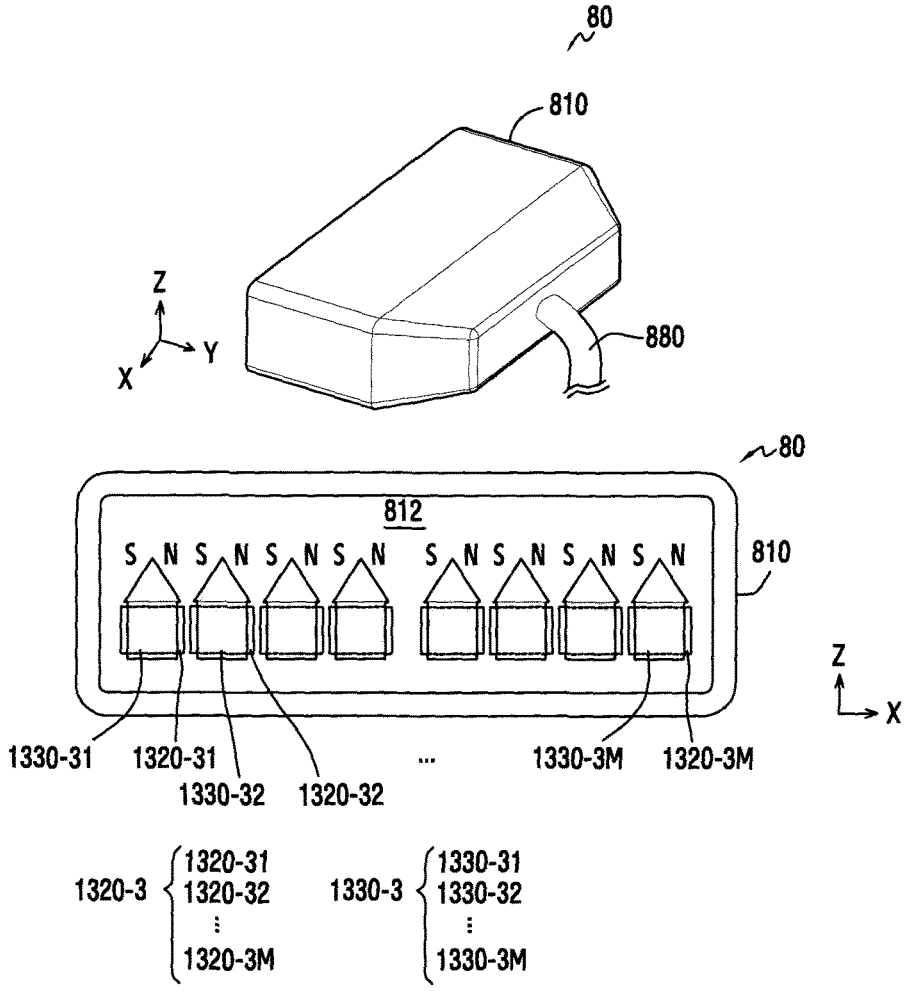
FIG. 13 illustrates a second connector according to this disclosure.

FIG. 13 illustrates an example second connector according to this disclosure.

Referring to FIG. 13, a second connector 80 may include a plurality of magnets 1320-3 and a plurality of conductive contact housings 1330-3.

The magnets 1320-3 may be separated individually. For example, the magnets 1320-3 may be arranged in a row along the X axis. A spacing between two neighboring magnets of the magnets 1320-3 may be or not be constant.

The magnets 1320-3 may have the same pole arrangement.

The conductive contact housings 1330-3 may correspond to the magnets 1320-3 one by one. Herein, the conductive contact housings 1330-3M may be in a shape (e.g., a round shape) surrounding at least one side of the magnet 1320-3.

In certain embodiments of the present disclosure, an electrical connection system can include a first connector, such as 70, and a second connector, such as 810. Connector 710 can include FIG. 10, while connector 80 can include FIG. 13, as is shown in FIG. 14.

Figure 14:
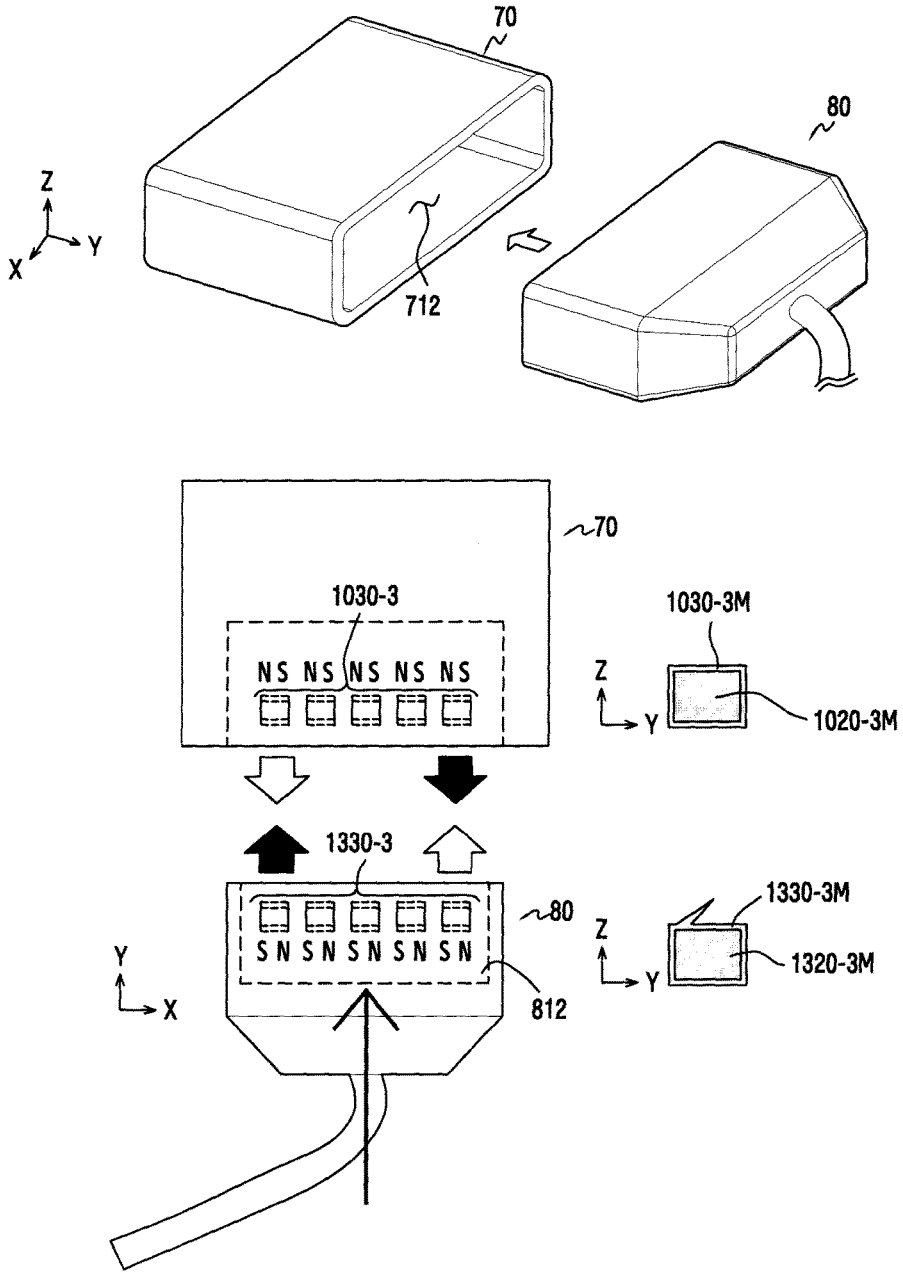
FIG. 14 and FIG. 15 illustrate coupling of a second connector to a first socket according to this disclosure.
Figure 15:
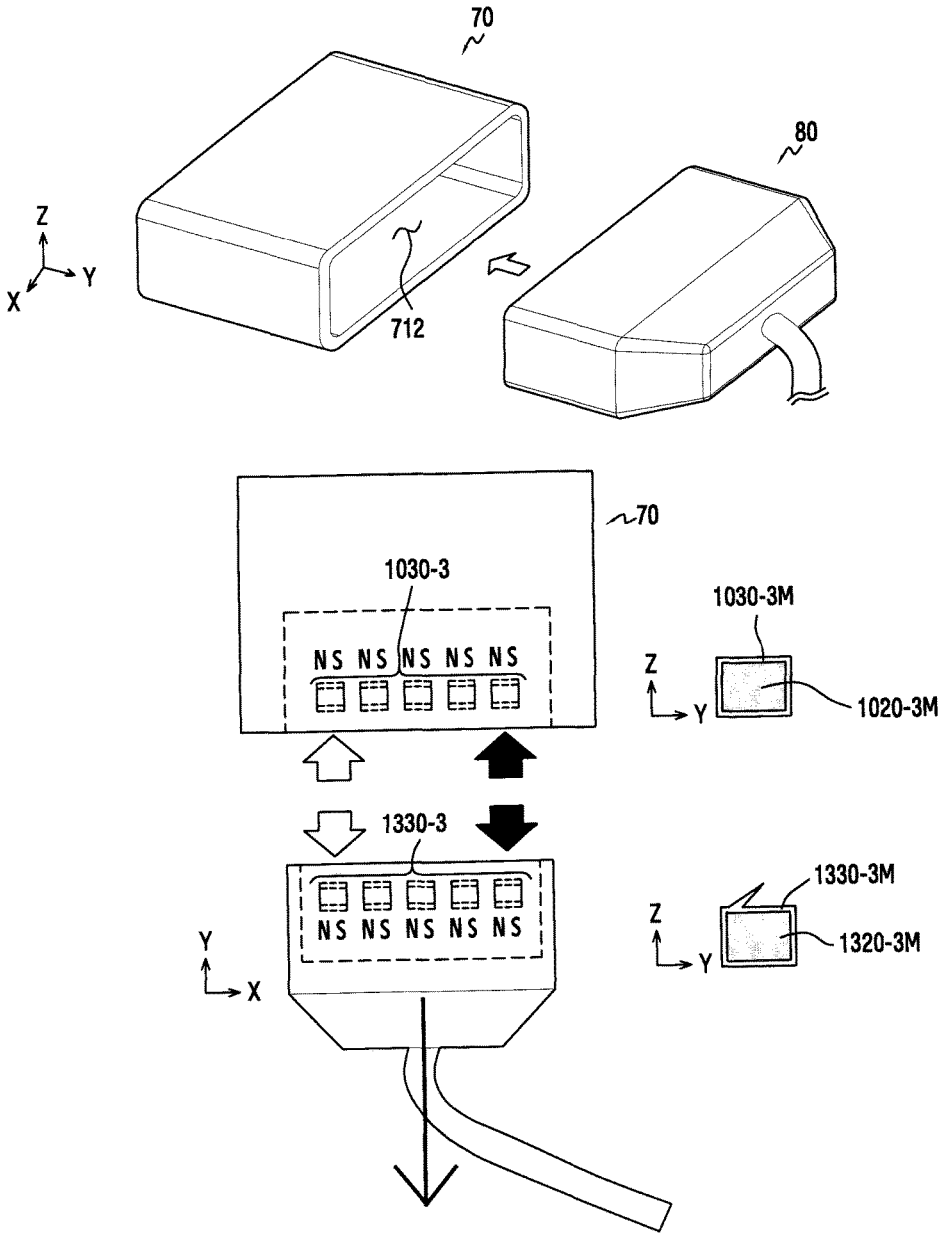

FIGS. 14 and 15 illustrate an example coupling of a second connector to a first socket according to this disclosure. To insert the second connector 80 into the first connector 70, the second connector 80 is moved toward the opening 711 of the first connector 70.

Referring to FIG. 14, there is attraction between the pole arrangement (e.g., S-N) of the magnets 1320-3M of the second connector 80 and the pole arrangement (e.g., N-S) of the magnets 1020-3M of the first connector 70, and the attraction may help in moving the second connector 80 into the receiver 712 of the first connector 70.

Although not depicted, when part of the second connector 80 is inserted into the receiver 712 of the first connector 70, the conductive contact housings 1030-3 of the first connector 70 may enter the receiver 812 of the second connector 80 and electrically contact the conductive contact housings 1330-3 in the receiver 812 of the second connector 80.

Referring to FIG. 15, there is repulsion between the pole arrangement (e.g., N-S) of the magnets 1320-3M of the second connector 80 and the pole arrangement (e.g., N-S) of the magnets 1020-3M of the first connector 70, and the repulsion may block the second connector 80 from moving into the receiver 712 of the first connector 70. The user may detect the repulsion and recognize that the second connector 80 is inserted into the first connector 70 in a wrong position. The user may turn the second connector 80 over for a correct position and then insert the second connector 80 into the first connector 70.

The skilled artisan will recognize the electric connectors system 7 described in FIG. 7, with more details in FIGS. 8-15 can represent electronic parts that can be symmetrical, such as connectors 70 and 80. However, even if connectors 70 and 80 are symmetrical, the proper configuration, e.g., FIG. 14, for connecting connectors 70 and 80 can easily be determined, unambiguously. Moreover, an improper configuration, such as FIG. 15 can be corrected by rotating one of the connectors, e.g., 80 with respect to the other connector 70. Unambiguous determination of the proper configuration can be determined by magnetic attraction within the connectors 70 and 80.

In certain embodiments, connection of possibly symmetrical components can be facilitated by a flexible mechanical component.

Figure 16:
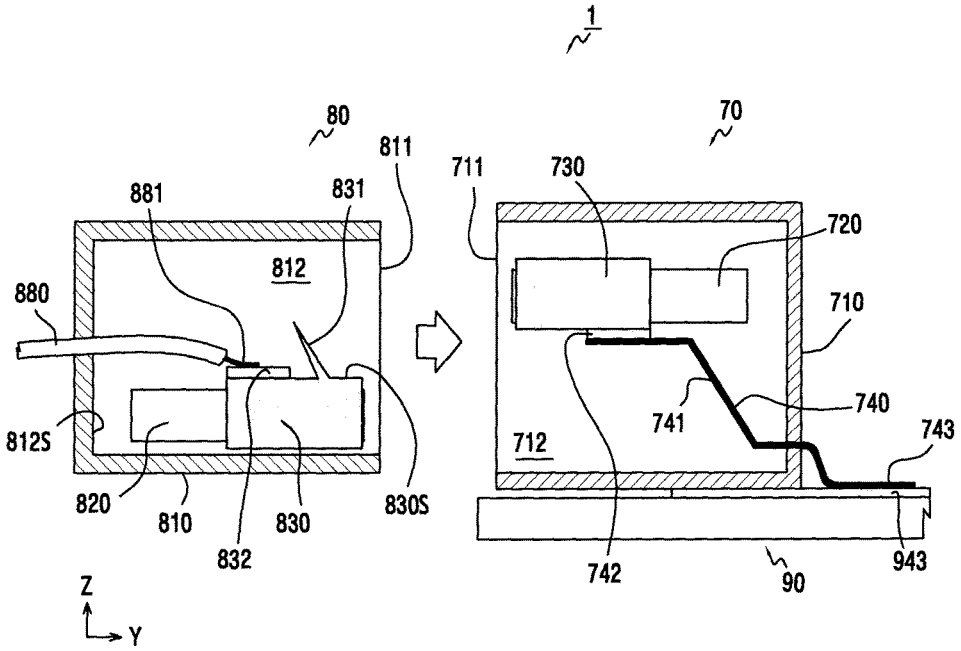
FIG. 16 illustrates a cross-sectional view of an electric connector system according to this disclosure.

FIG. 16 illustrates an example cross-sectional view of an electric connector system according to this disclosure.

The electric connector system 1 may include a first connector 70, a second connector 80, and a circuit board 90.

The first connector 70 may include a housing 710, a magnet 720, a conductive contact housing 730, and a metal support 740.

The housing 710 may include a receiver 712 including an opening 711. Some of the magnet 720, the conductive contact housing 730, and the metal support 740 may be disposed in the receiver 712.

The conductive contact housing 730 may be in a shape surrounding at least one side of the magnet 720.

The metal support 740 may be fixed to the housing 730. Part 741 of the metal support 740 may be disposed in the receiver 712 and connected to the conductive contact housing 730. For example, the metal support 740 may include a surface mounting pad 742 (e.g., a cooper pad or a land), and the conductive contact housing 730 may be connected to the surface mounting pad 742 using soldering. The conductive contact housing 730 is attached to the magnet 720, and accordingly the magnet 720 and the conductive contact housing 730 may be disposed in the receiver 712, mounted on the metal support 740. The part 741 of the metal support 740 may be elastic, and electric elastic contact may arise between the conductive contact housing 730 of the first connector 70 and the conductive contact housing 830 of the second connector 80.

A part 743 (e.g., a lead) of the metal support 740 may be extended outside the housing 710. The lead 743 may be connected to the surface mounting pad 943 of the circuit board 90 using soldering. Hence, the housing 710 may be secured to the circuit board 90 in virtue of the metal support 740.

As such, the circuit board 90 (e.g., a PCB) may include the surface mounting pad 943, and the first connector 70 may be secured to the surface mounting pad 943 using soldering.

The second connector 80 may include a housing 810, a magnet 820, a conductive contact housing 830, and an electric line 880.

The housing 810 may include a receiver 812 including an opening 811. Some of the magnet 820, the conductive contact housing 830, and the electric line 880 may be disposed in the receiver 812.

The conductive contact housing 830 may be in a shape surrounding at least one side of the magnet 820. The conductive contact housing 830 may be fixed on a surface 812S of the receiver 812. The conductive contact housing 830 may include an elastic piece 831 protruding and extending from a side 830S. When the second connector 80 is coupled to the first connector 70 or separated from the first connector 70, the elastic piece 831 may be elastically deformed (e.g., bent or drooped) and slidingly contact with respect to the side 830S of the conductive contact housing 830 of the first connector 70. Although not depicted, the elastic piece 831 may be formed in the conductive contact housing 730 of the first connector 70, instead of the second connector 80.

The electric line 880 outside the housing 810 may be extended into the receiver 812 of the housing 810. The electric line 880 may be electrically connected to the conductive contact housing 830. For example, the conductive contact housing 830 may include a surface mounting pad 832, and an end 881 of the electric line 880 may be connected to the surface mounting pad 832 using the soldering.

Figure 17:
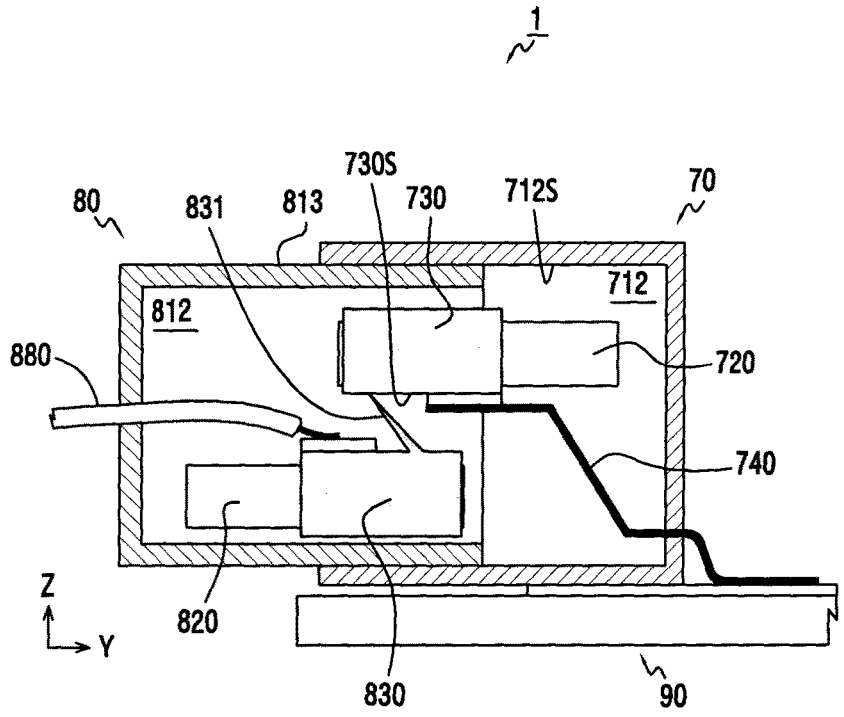
FIG. 17 illustrates a cross-sectional view of an electric connector system according to this disclosure.

FIG. 17 illustrates an example cross-sectional view of an electric connector system according to this disclosure. As stated earlier, when the pole arrangement of the magnet 720 of the first connector 70 and the pole arrangement of the magnet 820 of the second connector 80 attract one another, the second connector 80 may enter a receiver 712 of the first connector 70.

When the second connector 80 may enter the first connector 70, at least part of an outer surface 813 of the second connector 80 may slidingly contact a surface 712S of the first connector 70. Alternatively, the magnet 720 of the first connector 70 may be inserted into the receiver 812 of the second connector 80 and disposed above the magnet 820 of the second connector 80. The magnet 720 of the first connector 70 may be spaced from the magnet 820 of the second connector 80, and at least part of the magnet 720 of the first connector 70 may overlap the magnet 820 of the second connector 80.

The conductive contact housing 730 of the first connector 70 may be inserted into the receiver 812 of the second connector 80 and disposed above the conductive contact housing 830 of the second connector 80. An elastic piece 831 of the conductive contact housing 830 of the second connector 80 may be elastically deformed to contact the conductive contact housing 730 of the first connector 70, and the conductive contact housing 830 of the second connector 80 and the conductive contact housing 730 of the first connector 70 may be electrically connected. As the conductive contact housing 830 of the second connector 80 and the conductive contact housing 730 of the first connector 70 are electrically connected, an electric line 880 and a circuit board 90 may be electrically connected.

The elastic piece 831 of the second connector 80 may be tilted away from the insertion direction of the second connector 80 into the first connector 70. When the second connector 80 is inserted into the first connector 70, the elastic piece 831 may be bent toward the inclination. Alternatively, when the second connector 80 is separated from the first connector 70, the elastic piece 831 may apply a load to a side 730S of the conductive contact housing 730 of the first connector 70 and thus remove a foreign substance (e.g., dusts) of the side 730S of the conductive contact housing 730 of the first connector 70. The removal of the foreign substance may enhance the electric contact between the conductive contact housing 830 of the second connector 80 and the conductive contact housing 730 of the first connector 70.

Figure 18:
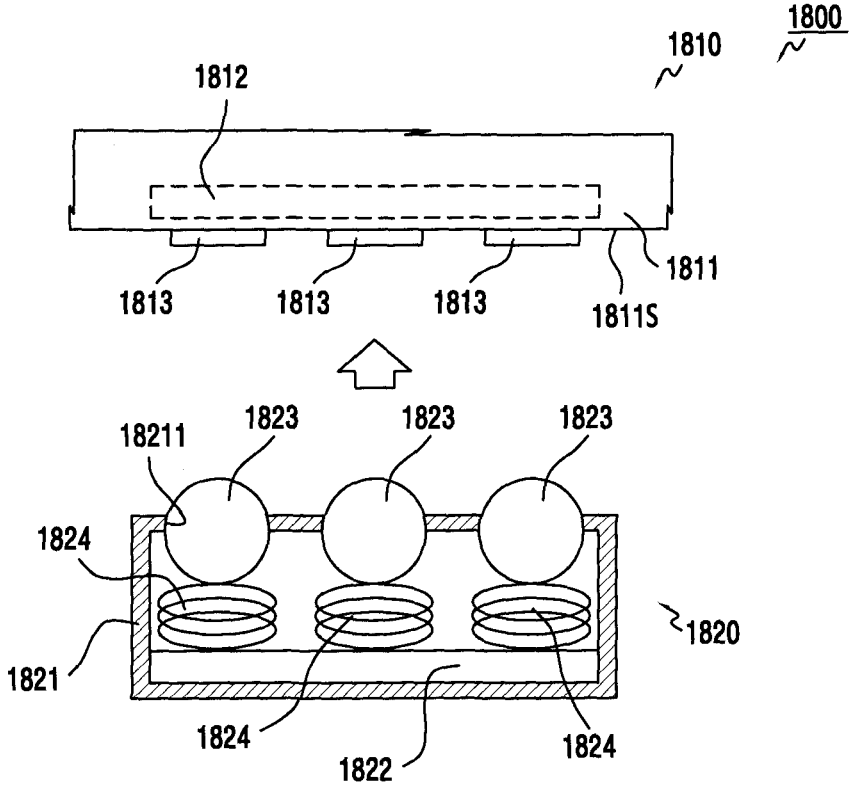
FIG. 18 illustrates an electric connector system according to this disclosure.

FIG. 18 illustrates an electric connector system according to this disclosure. Referring to FIG. 18, the electric connector system 1800 may include a first connector 1810 and a second connector 1820.

The first connector 1810 may include a housing 1811, a magnet 1812, and a plurality of metal pieces 1813. The housing 1811 may include a body for mounting the magnet 1812 and the metal pieces 1813. The magnet 1812 may be disposed in the housing 1811. The metal pieces 1813 may be disposed in a side 1811S of the housing 1811. The metal pieces 1813 may be attached to the magnet 1812.

The second connector 1820 may include a housing 1821, a magnet 1822, a plurality of metal balls 1823, and a plurality of elastic members 1824. The housing 1821 may include a body for mounting the magnet 1822, the metal balls 1823, and the elastic members 1824. The magnet 1822 may be disposed in the housing 1821. The metal balls 1823 may be disposed in an opening 18211 of the housing 1821. Some of the metal balls 1823 may protrude outside the housing 1821. The elastic members 1824 (e.g., compression springs) may be interposed between the metal balls 1823 and the magnet 1822. The elastic members 1823 may elastically support the metal balls 1823. The elastic members 1824 may include a piece of metal and electrically contact the metal balls 1823.

When the pole arrangement of the magnet 1812 of the first connector 1810 and the pole arrangement of the magnet 1822 of the second connector 1820 attract one another, the first connector 1810 may contact the second connector 1820. The metal pieces 1813 of the first connector 1810 may contact and be electrically connected to the metal balls 1823 of the second connector 1820. Herein, the elastic members 1824 of the second connector 1820 may assist in tightly contacting the metal balls 1823 of the second connector 1820 to the metal pieces 1813 of the first connector 1810 based on the attraction between the magnets 1812 and 1822.

When the pole arrangement of the magnet 1812 of the first connector 1810 and the pole arrangement of the magnet 1822 of the second connector 1820 repel one another, the repulsion may hinder the contact between the first connector 1810 and the second connector 1820.

Figure 19:
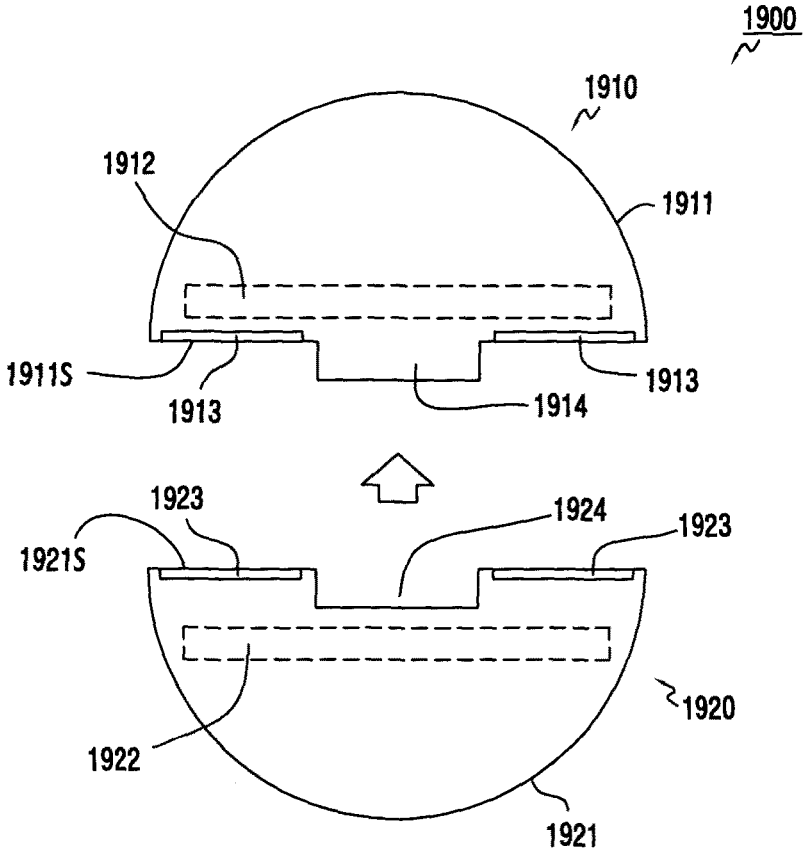
FIG. 19 illustrates an electric connector according to this disclosure.

FIG. 19 illustrates an example electric connector according to this disclosure.

Referring to FIG. 19, an electric connector 1900 may include a first connector 1910 and a second connector 1920.

The first connector 1910 may include a housing 1911, a magnet 1912, and a plurality of metal pieces 1913. The housing 1911 may include a protrusion 1914 formed in a side 1911S. The magnet 1912 may be disposed in the housing 1911. The metal pieces 1913 may be disposed in the side 1911S of the housing 1911 separated from the protrusion 1914. The metal pieces 1913 may be attached to the magnet 1912.

The second connector 1920 may include a housing 1921, a magnet 1922, and a plurality of metal pieces 1923. The housing 1921 may include a groove 1924 formed in a side 1921S. The magnet 1922 may be disposed in the housing 1921. The metal pieces 1923 may be disposed in a side of the housing 1921 separated from the groove 1924. The metal pieces 1923 may be attached to the magnet 1922.

When the pole arrangement of the magnet 1912 of the first connector 1910 and the pole arrangement of the magnet 1922 of the second connector 1920 attract one another, the side 1911S of the first connector 1910 and the side 1921S of the second connector 1920 may be coupled together. Herein, the protrusion 1914 of the first connector 1910 may be inserted in the groove 1924 of the second connector 1920. The metal pieces 1913 of the first connector 1910 and the metal pieces 1923 of the second connector 1920 may be contacted and electrically connected.

When the pole arrangement of the magnet 1912 of the first connector 1910 and the pole arrangement of the magnet 1922 of the second connector 1920 repel one another, the repulsion may hinder the coupling between the first connector 1910 and the second connector 1920.

Figure 20:
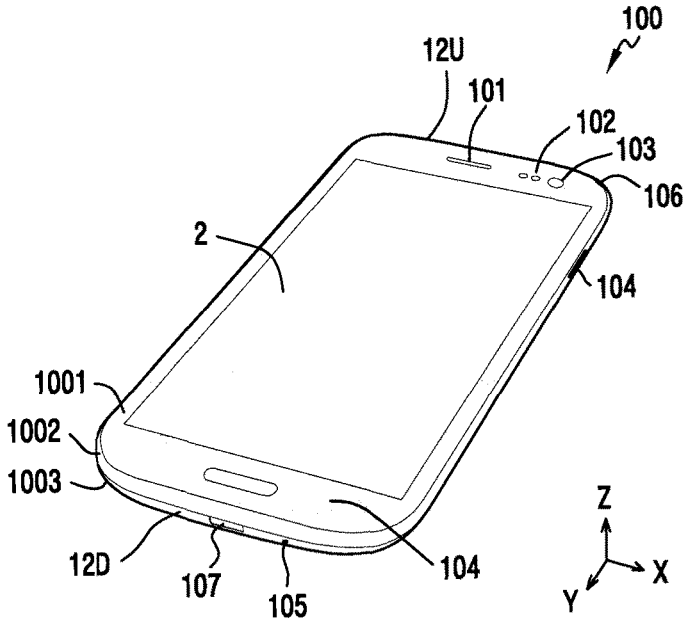
FIG. 20 illustrates an electronic device according to this disclosure.

FIG. 20 illustrates an example electronic device according to this disclosure. In certain embodiments, the electronic device 100 may comprise a portable electronic device. The portable electronic device may be connectable to an auxiliary electronic device using one of the connectors and mating connectors described in FIGS. 1-6.

Referring to FIG. 20, an electronic device 100 may include a top (or a front) 1001, a side 1002, and a bottom (or a back) 1003. The top 1001 and the bottom 1003 may be opposed to each other, and the side 1002 (or edges) may interconnect the top 1001 and the bottom 1003. The top 1001, the side 1002, or the bottom 1003 may include a flat surface or a curved surface. For example, although not depicted, the electronic device 100 may include the top 1001 or the bottom 1003 in a convex or concave curve. Alternatively, the electronic device 100 may be flexible or wearable to deform the top 1011, the side 1002, or the bottom 1003.

The electronic device 100 may include a display set 2, a speaker 101, a sensor 102, a camera 103, a button 104, a microphone 105, an antenna 106, and a socket 107.

The display set 2 may be disposed on the top 1001 of the electronic device 100. The display set 2 may include a Liquid Crystal Display (LCD) or an Active-Matrix Organic Light-Emitting Diode (AMOLED). Alternatively, the display set 2 may include a touch detector (e.g., a touch panel or a digitizer panel) for detecting a touch input.

The speaker 101 may be disposed on the top 1001 of the electronic device 100. Alternatively, although not depicted, the speaker 101 may be disposed on the side 1002 or the bottom 1003 of the electronic device 100.

The sensor 102 may be disposed on, but not limited to, the top 1001 of the electronic device 100. The sensor 102 may measure a physical quantity or detect an operation status of the electronic device 100, and convert the measured or detected information to an electric signal. The sensor 102 may include a gesture sensor, a proximity sensor, a grip sensor, a gyro sensor, an acceleration sensor, a geomagnetic sensor, an atmospheric pressure sensor, a temperature/humidity sensor, a Hall sensor, a red, green, and blue (RGB) sensor, a light sensor, a biometric sensor (e.g., a heart rate sensor), or an Ultra Violet (UV) sensor.

The camera 103 may be disposed on, but not limited to, the top 1001 of the electronic device 100.

The button 104 may be disposed in, but not limited to, the top 1001 or the side 1002 of the electronic device 100. The button 1094 may adopt a press type or a touch type.

The microphone 105 may be displayed in the side 1002 of the electronic device 100. Alternatively, although not depicted, the microphone 105 may be disposed on the top 1001 or the bottom 103 of the electronic device 100.

The antenna 106 (e.g., a Digital Multimedia Broadcasting (DMB) antenna, a cellular antenna) may be extended to outside through a through hole (not shown) in the side 1002 of the electronic device 100. Alternatively, although not depicted, the antenna 106 may be a built-in antenna in a housing, a case frame, or a circuit board (e.g., a main board) of the electronic device 100.

The socket 107 (e.g., the first connector 10) may be disposed in, but not limited to, the side 1002 of the electronic device 100. A socket (e.g., a Universal Serial Bus (USB) socket, a charger jack, or a communication jack) may be disposed in a lower section 12D of the side 1002. Alternatively, a socket (e.g., an ear jack) which is not shown may be disposed in an upper section 12U of the side 1002. The socket 107 is an interface device for connecting a plug (e.g., the second connector 20) of an external device (e.g., an ear set or a charger) and may adopt a communication method such as High Definition Multimedia Interface (HDMI), USB, projector, or D-subminiature (D-sub).

Although not depicted, the electronic device 100 may further include a stylus. The stylus may be detached to the outside through a through hole (not shown) in the side 1002 of the electronic device 100.

Figure 21:
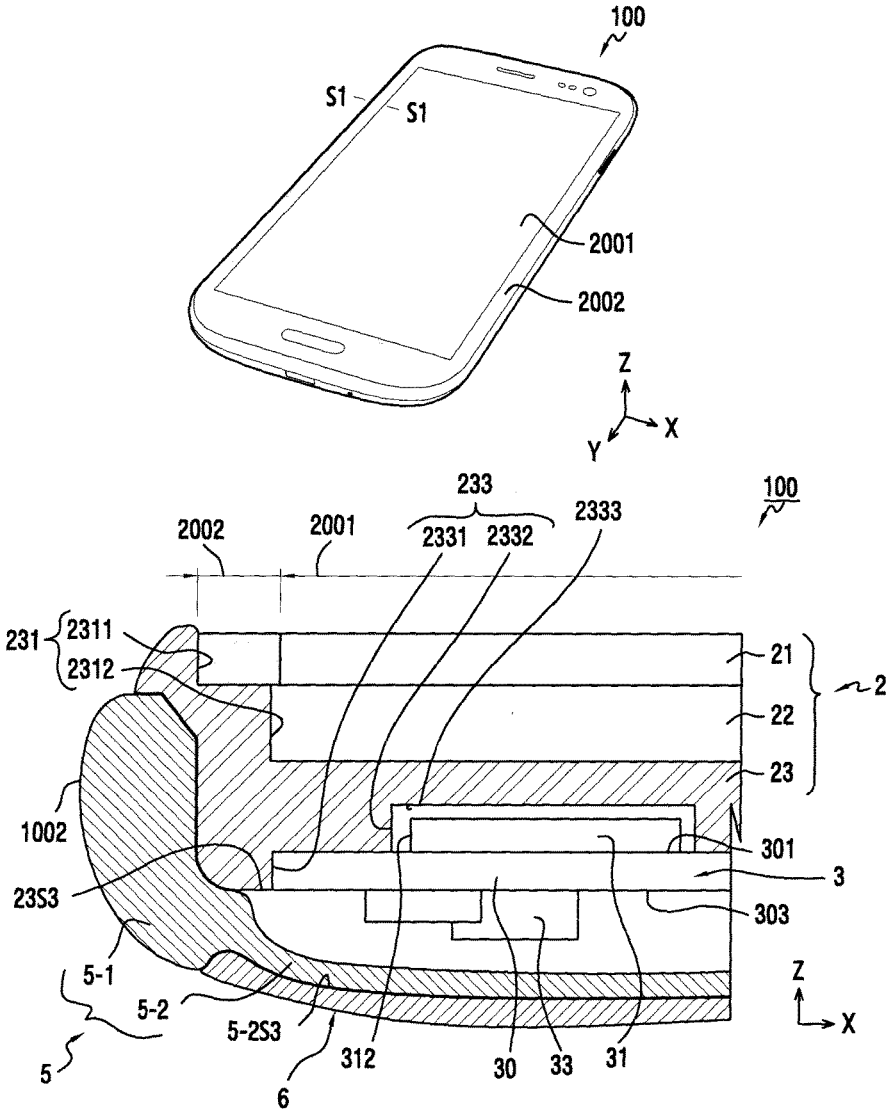
FIG. 21 illustrates a cross-sectional view of an electronic device according to this disclosure.

FIG. 21 illustrates a cross-sectional view of an example electronic device according to this disclosure.

Referring to FIG. 21, an electronic device 100 may include a display set 2, a Printed Board Assembly (PBA) 3, a device case 5, and a cover 6.

The display set 2 may include a window 21, a display 22, and a bracket 23.

The window 21 may include a transparent plate, an adhesive layer, a plastic film, a pattern layer, a metal layer, and a shielding layer.

The display 22 may be disposed below the window 21. For example, the display 22 may be attached to a transparent adhesive layer below the shielding layer. The display 22 may include a display panel (not shown). For example, the display panel may include an LCD or an AMOLED.

The display 22 may be flexible, transparent, or wearable. The window 21 may also be flexible or wearable.

The display set 2 may further include a circuit board (not shown). The circuit board may be disposed below the display panel. The PBA 3 may control an image on the display 22 using the circuit board. The circuit board of the display set 2 and the PBA 3 may be electrically connected as shown in one of FIGS. 1 through 6B. For example, the bracket 23 may include a through hole (not shown), and the circuit board of the display set 2 and the PBA 3 may be electrically connected via the through hole.

The display set 2 may further include a touch panel (not shown). The touch panel (e.g., a capacitive touch panel or a resistive touch panel) may be interposed between the window 21 and the display 22. Alternatively, the display set 2 may further include a digitizer panel (not shown). The digitizer panel may be disposed below the display panel. Herein, a visible region 2001 allows touch input using the touch panel or the digitizer panel, and may be referred to as a touch input region. The PBA 3 may detect the touch input to the touch panel or the digitizer panel using the circuit board.

The bracket 23 may include a mounting plate for mounting a plurality of electronic parts. The bracket 23 may include an upper mounting section 231 and a lower mounting section 233.

The upper mounting section 231 may include the window 21 and the display 22, and cover at least part of the top of the bracket 23. The upper mounting section 231 may include various shapes including a flat surface and/or a curved surface. The upper mounting section 231 may be opened upward. The window 21 may be disposed in an upper section 2311 (e.g., an upper open section) of the upper mounting section 231, and the display 22 may be disposed in a lower section 2312 of the upper mounting section 231. Herein, the window 21 and the display 22 may be attached to the upper mounting section 231 of the bracket 23 using an adhesive.

The lower mounting section 233 may include the PBA 3, and cover at least part of a bottom 23S3 of the bracket 23. The lower mounting section 233 may include various shapes including a flat surface and/or a curved surface. The lower mounting section 233 may include a board mounting section 2331 and a board part mounting section 2332.

A board 30 of the PBA 3 may be mounted in the board mounting section 2331. The board mounting section 2331 may include a boss (not shown). The board 30 may be secured to the board mounting section 2331 using a bolt.

An electronic part 31 projecting from a top 301 of the board 30 may be mounted in the board part mounting section 2332.

The bracket 23 may provide intended rigidity of the display set 2. Alternatively, the bracket 23 may block an electrical noise. Alternatively, the bracket 23 may include a heat radiating plate for preventing the electronic part from heating. Herein, the bracket 23 may diffuse the heat from the display 22 or the PBA 3.

The PBA 3 may include a circuit board, a main board, or a mother board. The PBA 3 may configure the electronic device 100, maintain configuration information, and stably drive the electronic device 100. The PBA 3 may facilitate data input/output exchange of devices. The electronic parts in the PBA 3 may be electrically connected as shown in at least one of FIGS. 1 through 19.

The PBA 3 may be interposed between the display set 2 and the device case 5. For example, the PBA 3 may be disposed below the lower mounting section 233 of the bracket 23. The PBA 3 may include a board 30, an upper board mounted part 31, and a lower board mounted part 33.

The board 30 may include a plate forming an electric circuit. The top 301 of the board 30 may contact at least part of the bottom 23S3 of the bracket 23. The bottom 303 of the board 30 may face the device case 5. The electronic part and the board 30 may be electrically connected as shown in at least one of FIGS. 1 through 19.

The upper board mounted part 31 may project upward from the top 301 of the board 30, and be disposed in the board part mounting section 2332 of the bracket 23. The lower board mounted part 33 may project downward from the bottom 303 of the board 30.

The upper board mounted part 31 and/or the lower board mounted part 33 may be of a Surface Mount Device (SMD) type or a Dual In link Package (DIP) type.

The device case 5 may include a first case body 5-1 and a second case body 5-2.

The first case body 5-1 may hold the display set 2 and include the side 1002 of the electronic device 100. The first case body 5-1 may be bolted to the bracket 23 of the display set 2.

The first case body 5-1 may include a shape (e.g., a groove), which is not shown, for mounting, for example, the socket 107 of FIG. 1. Alternatively, the first case body 5-1 may include a through hole (not shown). An external plug may be connected, electrically connected, or coupled to the socket 107 through the through hole. The socket 107 may be implemented as shown in one of FIGS. 8 through 10.

The second case body 5-2 may be extended from the first case body 5-1 and interposed between the PBA 3 and the cover 6. The second case body 5-2 may include a section for mounting the cover 6 at a bottom 5-2S3. Alternatively, the cover 6 may be easily detached from the second case body 5-2. For example, the cover 6 may include a plurality of hooks (not shown) arranged along edges, and the second case body 5-2 may include a plurality of hook grooves for coupling with the hooks of the cover 6. Herein, the coupling between the hooks of the cover 6 and the hook grooves of the second case body 5-2 may be referred to as snap fit.

The second case body 5-2 may include a support shape (not shown) for supporting the bottom 303 of the PBA 3.

The second case body 5-2 may be bolted to the display set 2.

The cover 6 may include the bottom 1003 (FIG. 15) of the electronic device 100. The cover 6 may be detached from the device case 5 when a detachable electronic part (e.g., a memory card or a battery pack) which is not shown is exchanged. Such a cover 6 may be referred to as a battery cover. An exposed surface (the bottom 1003 of the electronic device 100) of the cover 6 may include a curved surface. The exposed surface of the cover 6 may be smoothly connected to an exposed surface (the side 1002 of the electronic device 100) of the device case 5, thus decorating an exterior of the electronic device 100.

The device case 5 and the cover 6 together may be referred to as a housing. The housing may indicate a box-shaped section surrounding the electronic device 100.

Figure 22:
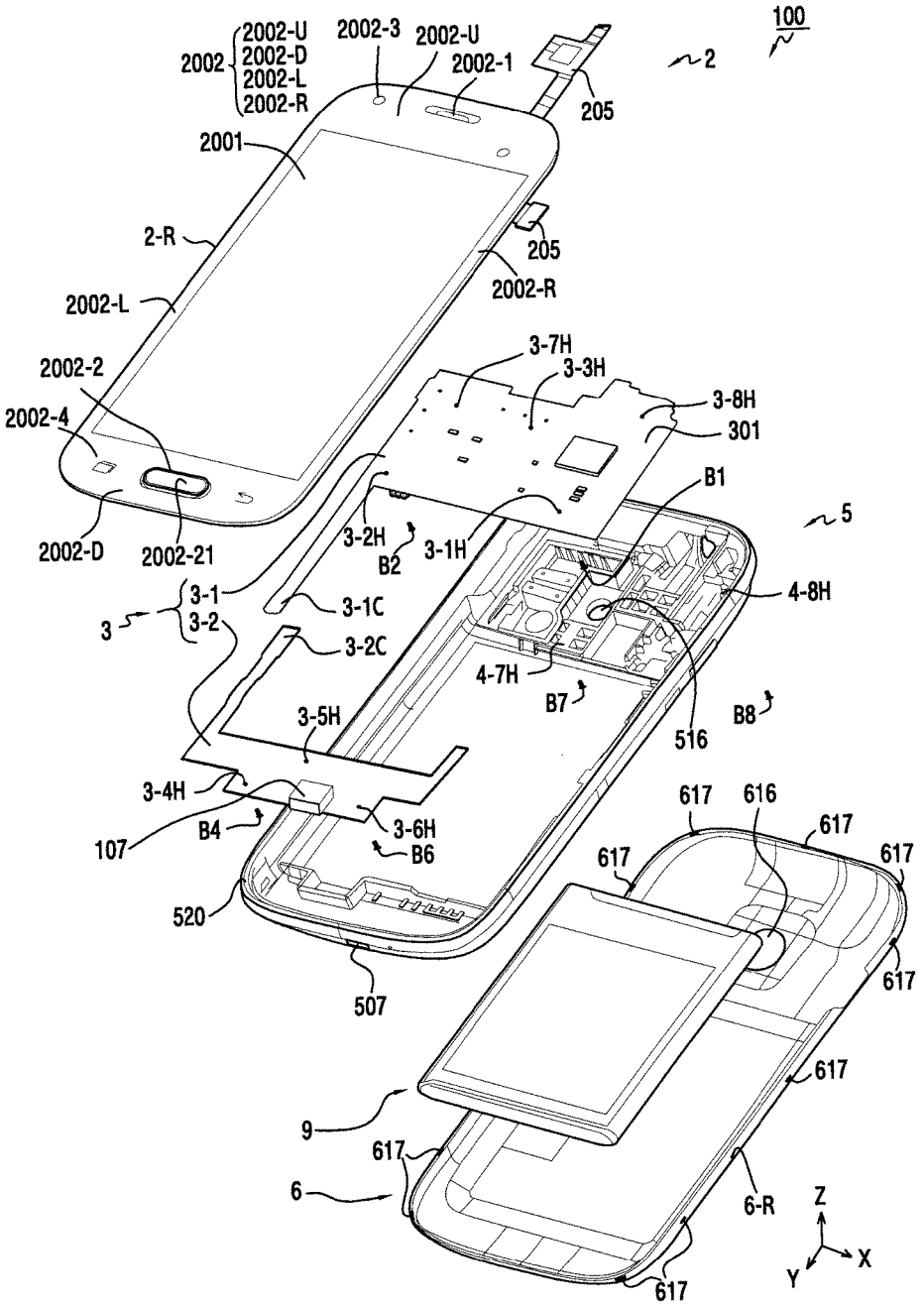
FIG. 22 illustrates an exploded view of an electronic device according to this disclosure.

FIG. 22 illustrates an exploded view of an example electronic device according to this disclosure.

Referring to FIG. 22, an electronic device 100 may include a display set 2, a PBA 3, a device case 5, a battery pack 9, and a cover 6.

The display set 2 may be of a quadrangular (e.g., rectangular) flat plate type. The display set 2 may include a display region 2001 and a non display region 2002. The display region 2001 may correspond to an image display region, that is, a screen of the display 22 (FIG. 20). The display region 2001 may be an elongated rectangular. The non display region 2002 (e.g., an edge region 2002 of FIG. 20) may be of a ring type surrounding the display region 2001. For example, the non display region 2002 may include an upper edge region 2002-U, a lower edge region 2002-D, a left edge region 2002-L, and a right edge region 2002-R. The upper edge region 2002-U and the lower edge region 2002-D may face each other. The left edge region 2002-L and the right edge region 2002-R may face each other. The upper edge region 2002-U or the lower edge region 2002-D may be relatively wider than the left edge region 2002-L or the right edge region 2002-R. The non display region 2002 may be black. Alternatively, the non display region 2002 may present a metal texture.

The display set 2 may include a receiver hole 2002-1 in the non display region 2002 (e.g., the upper edge region 2002-U). The receiver hole 2002-1 may correspond to a receiver (not shown) of the PBA 3 or the device case 5, and emit a sound output from the receiver to the outside through the receiver hole 2002-1.

The display set 2 may include a button hole 2002-2 in the non display region 2002 (e.g., the lower edge region 2002-D). The display set 2 may include a button circuit (not shown) interposed between the window 21 of FIG. 20 and the bracket 23 of FIG. 20. A button 2002-21 of the button circuit may be disposed on the top 1001 of FIG. 15 in the electronic device 100 through the button hole 2002-2.

The display set 2 may further include a transparent region 2002-3 in the non display region 2002. The transparent region 2002-3 may correspond to a sensor (e.g., a light sensor or an image sensor) of the PBA 3.

The display set 2 may further include a touch key marker 2002-4 in the non display region 2002. The touch key marker 2002-4 may be disposed on both sides of the button hole 2002-2. The display set 2 may further include a touchy key circuit (not shown) between the window 21 and the bracket 23. The touch key circuit may correspond to the touch key marker 2002-4.

The display set 2 may include an electrical connecting means 205. The electrical connecting means 205 may be used to electrically connect the display 22 (FIG. 20) of the display set 2 or a touch key device (e.g., a touch panel or a digitizer panel), which is not shown, with the PBA 3. The electrical connecting means 205 may be used to electrically connect the button circuit or the touch key circuit of the display set 2 with the PBA 3. One end (not shown) of the electrical connecting means 205 may include a connector (e.g., a male connector or a female connector) connectable with a connector of the PBA 3. The electrical connecting means 205 is bendable to be connected to a connector at the bottom 303 (FIG. 15) of the PBA 3. For example, the electrical connecting means 205 may include an FPCB.

The PBA 3 may be interposed between the display set 2 and the device case 5. The bracket 23 (FIG. 20) of the display set 2 may be mounted in the PBA 3. Herein, the PBA 3 and the display set 2 may be electrically connected as shown in at least one of FIGS. 1 through 19.

The PBA 3 may include a plurality of circuit boards 3-1 and 3-2 separable. For example, the PBA 3 may include the first circuit board 3-1 and the second circuit board 3-2 disposed on both sides of the electronic device 100 respectively. The first circuit board 3-1 may include a first connector 3-1C in an edge region 3-R of the lower mounting section 233 (FIG. 20) of the bracket 23. The first connector 3-1C may be relatively projected and extended, compared to the other part of the first connector 3-1C. The second circuit board 3-2 may include a second connector 3-2C in the edge region 3-R of the lower mounting section 233 (FIG. 20) of the bracket 23. The second connector 3-2C may be relatively projected and extended, compared to the other part of the second connector 3-2C. The first connector 3-1C and the second connector 3-2C may be coupled and the first circuit board 3-1 and the second circuit board 3-2 may electrically communicate with each other. The second circuit board 3-2 may include a socket 107 (e.g., the first connector 10). The socket 107 may correspond to a through hole 507 of the device case 5. The first circuit board 3-1 and the second circuit board 3-2 may be electrically connected as shown in at least one of FIGS. 1 through 19.

The PBA 3 may include a plurality of bolt holes 3-1H through 3-8H. The bolt holes 3-1H through 3-8H may correspond to a plurality of bosses (not shown) of the bracket 23. The PBA 3 may include the through hole 507. The through hole 507 may communicate with a receiver (e.g., the receiver 112) of the socket 107 of the PBA3.

A plurality of bolts B1 through B1 through B6 pass through the bolt holes 3-1H through 3-8H of the PBA 3 and are coupled with the bosses of the bracket 23. Hence, the PBA 3 and the bracket 23 may be coupled together.

The device case 5 may include a plurality of bolt holes 4-7H and 4-8H. The bolt holes 4-7H and 4-8H may correspond to the bolts 3-7H and the 3-8H of the PBA 3. The bolts B7 and B8 pass through the bolt holes 4-7H and 4-8H of the device case 5 and the bolt holes 3-7H and the 3-8H of the PBA 3, and are coupled with the bosses of the bracket 23. Thus, the device case 5, the PBA 3, and the bracket 23 may be coupled together.

The device case 5 may be disposed below the PBA 3. An upper open section 520 may include a section for mounting the display set 2.

The device case 5 may include a conductive material. The conductive material may reduce an electric noise of the electronic device 100. Alternatively, the conductive material may diffuse the heat from a heating part (e.g., the PBA 3). For example, a heat interface material may be interposed between the PBA 3 and the device case 5.

The device case 5 may include a transparent window 516. For example, the transparent window 516 may correspond to an optical electronic part (e.g., a camera module) at the bottom 303 (FIG. 20) of the PBA 3.

The battery pack 9 may be disposed in a battery pack mounting section at the bottom 5-2S3 (FIG. 20) of the device case 5.

The cover 6 may be disposed below the device case 5. The cover 6 may include a through hole 616 and a plurality of hooks 617. The through hole 616 may correspond to the transparent window 516 of the device case 5. The hooks 617 may be disposed at an edge 6-R. The hooks 617 are coupled with a plurality of hook grooves (not shown) of the device case 5, and thus the cover 6 may be coupled to the device case 5.

The electronic device 100 may further include a circuit device including an antenna or a speaker (not shown) interposed between the second circuit board 3-2 and the device case 5. The circuit device and the PBA 3 may be electrically connected as shown in one of FIGS. 1 through 19.

According to an embodiment of the present disclosure, a connector 10 may include a plurality of contacts electrically connected to a mating connector and separated from one another. Herein, at least one 11-M of the contacts may include a magnet 12, and a conductive housing 13 for surrounding at least one side of the magnet 12.

According to an embodiment of the present disclosure, the conductive housing 13 may be ring shaped or round-shaped.

According to an embodiment of the present disclosure, when electrically connected to the mating connector, the conductive housing 13 may include an elastically deformable section (the elastic piece 1131 of FIG. 11).

According to an embodiment of the present disclosure, the at least one side of the magnet 12 may include a flat surface or a curved surface.

According to an embodiment of the present disclosure, the contacts each may include the magnet and the conductive housing, and the magnets may have the same pole arrangement.

According to an embodiment of the present disclosure, the contacts each may include the magnet and the conductive housing, and at least one of the magnets may have an opposite pole arrangement from other magnets.

According to an embodiment of the present disclosure, the connector 10 may include a socket or a plug.

According to an embodiment of the present disclosure, the connector 10 may be mounted on a circuit board.

According to an embodiment of the present disclosure, the connector 10 may further include a cable or a Flexible Printed Circuit Board (FPCB) electrically connected to the contacts 13.

According to an embodiment of the present disclosure, the contacts 13 may be disposed on a surface of a housing which forms an exterior of an electronic device.

According to an embodiment of the present disclosure, an electronic device 100 may include a socket 107 connected to an external plug. The socket 107 (e.g., the first connector 70 of FIG. 7) may include a housing 710 and a plurality of contacts disposed inside the housing 710 and separated from one another. At least one of the contacts may include a magnet 1020-3M and a conductive housing 1030-3M for surrounding at least one side of the magnet.

According to an embodiment of the present disclosure, the conductive housing 1030-3M may be ring-shaped or round-shaped.

According to an embodiment of the present disclosure, the socket 70 may be mounted on a circuit board (e.g., the PBA 3) inside the electronic device.

According to an embodiment of the present disclosure, the external plus may be for charging or data communication.

According to an embodiment of the present disclosure, a connector system may include a first connector 70 and a second connector 80 electrically connectable to each other. The first connector 70 may include a plurality of first magnets 1020-3M and a plurality of first contacts 1030-3M for surrounding at least one side of the first magnets 1020-3M respectively. The second connector 80 may include a plurality of second magnets 1320-3M corresponding to the first magnets; and a plurality of second contacts 1330-3M corresponding to the first contacts 1030-3M and surrounding at least one side of the second magnets 1320-3M respectively. When there is attraction between the first magnets 1020-3M and the second magnets 1330-3M, the attraction acts as a force for pulling the first contacts 1030-3M and the second contacts 1330-M toward one another. When there is repulsion between the first magnets 1020-3M and the second magnets 1320-3M, the repulsion acts as a force for pushing the first contacts 1030-3M and the second contacts 1330-3M away from one another.

According to an embodiment of the present disclosure, the first contacts 1030-3M or the second contacts 1330-3M may be ring-shaped or round-shaped.

According to an embodiment of the present disclosure, the first magnets 1020-3M and the second magnets 1320-3M may have the same pole arrangement.

According to an embodiment of the present disclosure, the first connector 70 may include a socket, and the second connector 80 may include a plug.

According to an embodiment of the present disclosure, the first connector 70 or the second connector 80 may be mounted on a circuit board.

According to an embodiment of the present disclosure, the first connector 70 or the second connector 80 may be mounted on a surface of a housing (e.g., the device case 5 or the battery cover 6) which forms an exterior of an electronic device 100.

Figure 23:
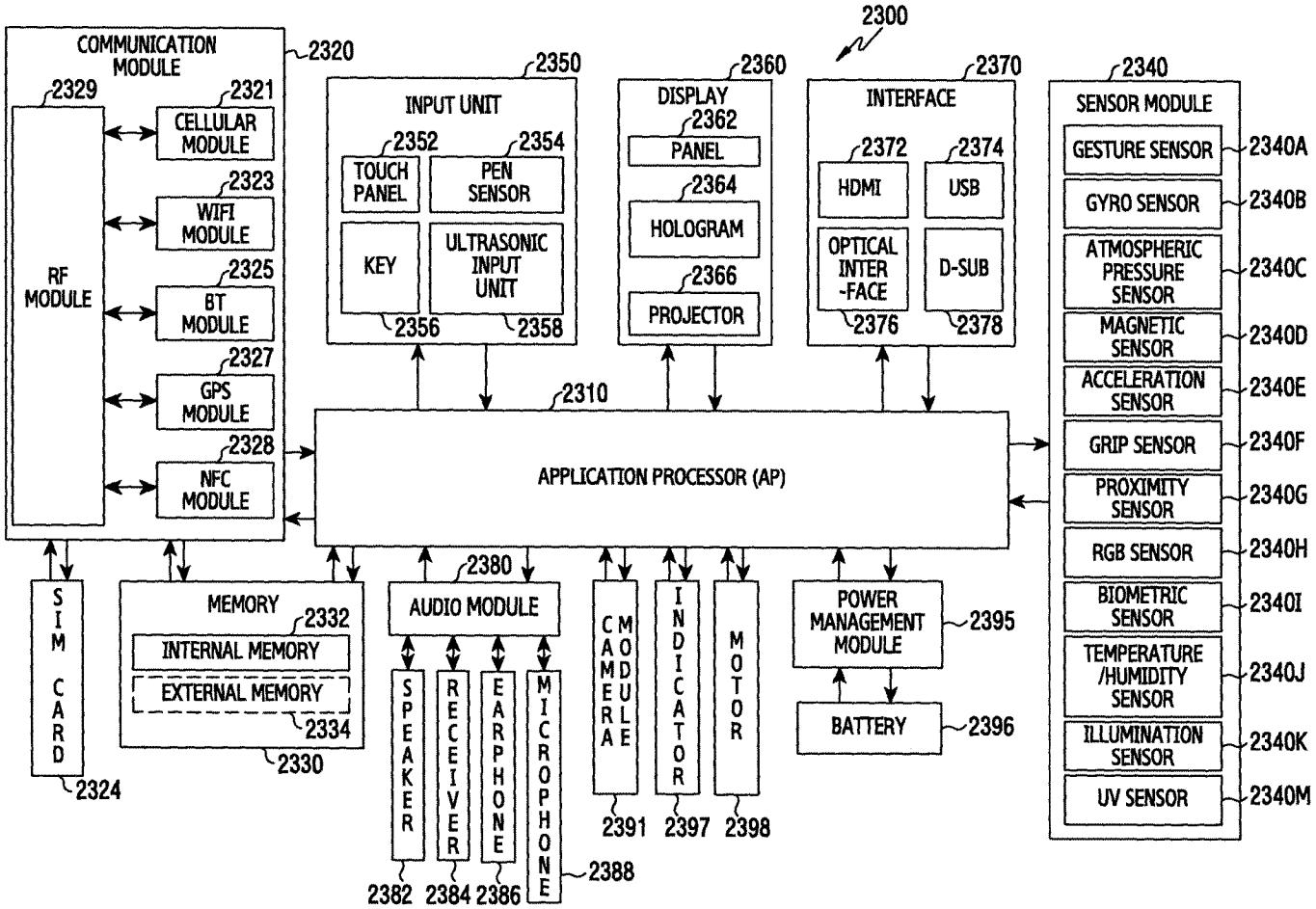
FIG. 23 illustrates a block diagram of an electronic device according to this disclosure.

FIG. 23 illustrates a block diagram of an example electronic device according to this disclosure. An electronic device 2300 constitutes, for example, the entirety or a part of the electronic device 100 illustrated in FIG. 20. Referring to FIG. 23, the electronic device 2300 includes one or more Application Processors (APs) 2310, a communication module 2320, a Subscriber Identifier Module (SIM) card 2324, a memory 2330, a sensor module 2340, an input device 2350, a display 2360, an interface 2370, an audio module 2380, a camera module 2391, a power management module 2395, a battery 2396, an indicator 2397, and a motor 2398. The AP 2310 controls a plurality of hardware or software elements connected thereto by driving an operating system or an application program and perform data processing and calculations on various types of data including multimedia data. The AP 2310 is implemented as, for example, a System on Chip (SoC). According to an embodiment, the AP 2310 further includes a Graphic Processing Unit (GPU).

The communication module 2320 performs data transmission/reception in communication between the electronic device 2300 (such as the electronic device 100 of FIG. 20) and other electronic devices connected thereto through a network. According to an embodiment, the communication module 2320 includes a cellular module 2321, a Wi-Fi module 2323, a BT module 2325, a GPS module 2327, an NFC module 2328, and a Radio Frequency (RF) module 2329.

The cellular module 2321 provides a voice call, a video call, a text message service, an Internet service or the like through a communication network (such as Long Term Evolution (LTE), LTE-A, Code Division Multiple Access (CDMA), Wideband CDMA (WCDMA), Universal Mobile Telecommunication System (UMTS), Wireless Broadband (WiBro), Global System for Mobile communication (GSM), or the like). Furthermore, the cellular module 2321 distinguishes between and authenticate electronic devices within a communication network, for example, using a subscriber identification module (such as the SIM card 2324). According to an embodiment, the cellular module 2321 performs at least some of the functions that the processor 2310 provides. For example, the cellular module 2321 performs at least some of the multimedia control functions.

According to an embodiment, the cellular module 2321 includes a Communication Processor (CP). In addition, the cellular module 2321 is implemented as, for example, an SoC. In FIG. 23, the elements such as the cellular module 2321 (such as a communication processor), the memory 2330, and the power management module 2395 are illustrated to be separate from the AP 2310. However, according to an embodiment, the AP 2310 includes at least some of the aforementioned elements (such as the cellular module 2321).

According to an embodiment, the AP 2310 or the cellular module 2321 (such as a communication processor) loads instructions or data, received from at least one of a non-volatile memory and the other elements connected thereto, in a volatile memory and process the loaded instructions or data. In addition, the AP 2310 or the cellular module 2321 stores data received from or generated by at least one of the other elements in a non-volatile memory.

The Wi-Fi module 2323, the BT module 2325, the GPS module 2327, or the NFC module 2328 includes a processor for processing data transmitted/received through the corresponding module. In FIG. 23, the cellular module 2321, the Wi-Fi module 2323, the BT module 2325, the GPS module 2327, and the NFC module 2328 are illustrated as separate blocks. However, according to an embodiment, at least some (such as two or more) of the cellular module 2321, the Wi-Fi module 2323, the BT module 2325, the GPS module 2327, and the NFC module 2328 is included in one integrated chip (IC) or IC package. For example, at least some of the processors corresponding to the cellular module 2321, the Wi-Fi module 2323, the BT module 2325, the GPS module 2327, and the NFC module 2328 (such as a communication processor corresponding to the cellular module 2321 and a Wi-Fi processor corresponding to the Wi-Fi module 2323) is implemented as one SoC.

The RF module 2329 transmits and/or receives data, for example, an RF signal. The RF module 2329 includes, for example, a transceiver, a Power Amp Module (PAM), a frequency filter, a Low Noise Amplifier (LNA), and the like. In addition, the RF module 2329 further includes a component, for example a conductor or conducting wire, for transmitting/receiving electromagnetic waves over free air space in wireless communication. In FIG. 23, the cellular module 2321, the Wi-Fi module 2323, the BT module 2325, the GPS module 2327, and the NFC module 2328 are illustrated to share one RF module 2329. However, according to an embodiment, at least one of the cellular module 2321, the Wi-Fi module 2323, the BT module 2325, the GPS module 2327, and the NFC module 2328 transmit and/or receives an RF signal through a separate RF module.

The SIM card 2324 is a card including a subscriber identification module, and is inserted into a slot formed at a predetermined position of the electronic device. The SIM card 2324 includes unique identification information (such as an integrated circuit card identifier (ICCID)) or subscriber information (such as an international mobile subscriber identity (IMSI)).

The memory 2330 includes an internal memory 2332 and an external memory 2334. The internal memory 2332 includes at least one of, for example, a volatile memory (such as a Dynamic Random Access Memory (DRAM), a Static RAM (SRAM), a Synchronous Dynamic RAM (SDRAM), or the like) or a non-volatile memory (such as a One Time Programmable Read Only Memory (OTPROM), a Programmable ROM (PROM), an Erasable and Programmable ROM (EPROM), an Electrically Erasable and Programmable ROM (EEPROM), a mask ROM, a flash ROM, a NAND flash memory, a NOR flash memory, or the like).

According to an embodiment, the internal memory 2332 is a Solid State Drive (SSD). The external memory 2334 further includes a flash drive, for example, a Compact Flash (CF), a Secure Digital (SD), a Micro Secure Digital (Micro-SD), a Mini Secure Digital (Mini-SD), an extreme Digital (xD), a memory stick, or the like. The external memory 2334 is functionally connected to the electronic device 2300 through various interfaces. According to an embodiment, the electronic device 2300 further includes a storage device (or storage medium) such as a hard disc drive.

The sensor module 2340 measures a physical quantity or sense an operating state of the electronic device 2300 and convert the measured or sensed information into an electric signal. The sensor module 2340 includes at least one of, for example, a gesture sensor 2340A, a gyro sensor 2340B, an atmospheric pressure sensor 2340C, a magnetic sensor 2340D, an acceleration sensor 2340E, a grip sensor 2340F, a proximity sensor 2340G, a color sensor 2340H (such as Red, Green, and Blue (RGB) sensor), a biometric sensor 2340I, a temperature/humidity sensor 2340J, an illumination sensor 2340K, and an Ultra Violet (UV) sensor 2340M. Additionally or alternatively, the sensor module 2340 includes, for example, an E-nose sensor, an electromyography (EMG) sensor, an electroencephalogram (EEG) sensor, an electrocardiogram (ECG) sensor, an Infrared (IR) sensor, an iris sensor, a fingerprint sensor, or the like. The sensor module 2340 further includes a control circuit for controlling one or more sensors included therein.

The input device 2350 includes a touch panel 2352, a (digital) pen sensor 2354, a key 2356, or an ultrasonic input device 2358. The touch panel 2352 recognizes a touch input based on at least one of, for example, a capacitive type, a resistive type, an infrared type, and an acoustic wave type. In addition, the touch panel 2352 further includes a control circuit. The capacitive type touch panel recognizes physical contact or proximity. The touch panel 2352 further includes a tactile layer. In this case, the touch panel 2352 provides a user with a tactile reaction.

The (digital) pen sensor 2354 is implemented, for example, in the same or a similar method to receiving a user's touch input or using a separate sheet for recognition. The key 2356 includes, for example, a physical button, an optical key, or a keypad. The ultrasonic input unit 2358 identifies data by detecting an acoustic wave with a microphone of the electronic device 2300 through an input unit for generating an ultrasonic signal, and wireless recognition is possible. According to an embodiment, the electronic device 2300 receives a user input from an external device (such as a computer or server) connected thereto using the communication module 2320.

The display 2360 includes a panel 2362, a hologram device 2364, or a projector 2366. The panel 2362 is, for example, a Liquid Crystal Display (LCD), an Active Matrix Organic Light Emitting Diode (AM-OLED), or the like. The panel 2362 is implemented to be, for example, flexible, transparent, or wearable. The panel 2362 is formed as a single module together with the touch panel 2352. The hologram device 2364 shows a stereoscopic image in the air using interference of light. The projector 2366 displays an image by projecting light onto a screen. The screen is disposed in the interior of or on the exterior of the electronic device 2300. According to an embodiment, the display 2360 further includes a control circuit for controlling the panel 2362, the hologram device 2364, or the projector 2366.

The interface 2370 includes, for example, a High-Definition Multimedia Interface (HDMI) 2372, a Universal Serial Bus (USB) 2374, an optical interface 2376, or a D-subminiature (D-sub) 2378. Additionally or alternatively, the interface 2370 includes, for example, a Mobile High-definition Link (MHL) interface, a Secure Digital (SD) card/MultiMedia Card (MMC) interface, or an Infrared Data Association (IrDA) standard interface.

The audio module 2380 bilaterally converts a sound and an electrical signal. The audio module 2380 processes sound information input or output through, for example, a speaker 2382, a receiver 2384, earphones 2386, the microphone 2388, or the like.

The camera module 2391 is a device for capturing a still image or a video, and according to an embodiment, includes one or more image sensors (such as a front sensor or a rear sensor), a lens, an Image Signal Processor (ISP), or a flash (such as an LED or xenon lamp).

The power management module 2395 manages the power of the electronic device 2300. The power management module 2395 includes, for example, a Power Management Integrated Circuit (PMIC), a charger Integrated Circuit (IC), or a battery or fuel gauge.

The PMIC is mounted, for example, in an integrated circuit or an SoC semiconductor. Charging methods is classified into a wired charging method and a wireless charging method. The charger IC charges a battery and prevents the introduction of over-voltage or over-current from a charger. According to an embodiment, the charger IC includes a charger IC for at least one of the wired charging method and the wireless charging method. Examples of the wireless charging method includes, for example, a magnetic resonance method, a magnetic induction method, and an electromagnetic wave method, and an additional circuit for wireless charging, such as a coil loop circuit, a resonance circuit, or a rectifier circuit, is added.

The battery gauge measures, for example, a residual quantity of the battery 2396, and a voltage, a current, or a temperature while charging. The battery 2396 stores or generates electricity and supplies power to the electronic device 2300 using the stored or generated electricity. The battery 2396 includes, for example, a rechargeable battery or a solar battery.

The indicator 2397 indicates a particular state of the electronic device 2300 or a part thereof (such as the AP 2310), such as a boot-up state, a message state, a charging state, or the like. The motor 2399 converts an electric signal into mechanical vibration. The electronic device 2300 includes a processing unit (such as a GPU) for supporting mobile TV. The processing device for supporting mobile TV processes, for example, media data associated with the standard of Digital Multimedia Broadcasting (DMB), Digital Video Broadcasting (DVB), a media flow, or the like.

The above-stated components of the electronic device 2300 may be electrically connected as shown in one of FIGS. 1 through 19.

As set forth above, when the connectors repel each other, the user may recognize the wrong connection between of the connectors and try a correct connection between the connectors. In addition, the attraction between the connectors may enhance the connection of the connectors.

The aforementioned components of the electronic device according to various exemplary embodiments of the present disclosure each may include one or more components, and the name of the corresponding component may differ according to the type of the electronic device. The present electronic device may include at least one of the aforementioned components, omit some components, or further include other components. Also, some of the components of the present electronic device may be united into a single entity to thus carry out the same functions of the corresponding components.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A connector comprising:

a first housing comprising a cavity, the cavity configured to detachably couple to a second housing of a mating connector;

at least one first magnet disposed within the cavity in a parallel configuration along a transverse direction perpendicular to an inserted direction in which the second housing is inserted into the cavity of the first housing, wherein a pole of the at least one first magnet faces in a vertical direction perpendicular to the insertion direction and the transverse direction; and a first plurality of contacts disposed, facing in the vertical direction, on the at least one first magnet, wherein the first plurality of contacts are capable of electrically connecting with a second plurality of contacts disposed on at least one second magnet of the mating connector.

2. The connector of claim 1, wherein each contact in the first plurality of contacts is ring-shaped and is surrounding at least one side of the at least one first magnet.

3. The connector of claim 1, wherein each contact in the first plurality of contacts includes an elastically deformable section protruding thereof in the vertical direction, each contact in the second plurality of contacts includes an elastically deformable support, and when the first plurality of contacts and the second plurality of contacts are electrically connected, the elastically deformable section and the elastically deformable support are both elastically deformed.

4. The connector of claim 1, wherein at least one side of the at least one magnet comprises a curved surface.

5. The connector of claim 1, wherein the at least one magnet is bar-shaped extending along in the transverse direction.

6. The connector of claim 5, wherein the at least one magnet comprises a first magnet and a second magnet disposed in a parallel configuration along the transverse direction, and wherein the first magnet has an opposite pole with respect to the second magnet.

7. The connector of claim 1, wherein the connector includes a socket, and the mating connector includes a plug.

8. The connector of claim 1, wherein the connector is mounted on a circuit board.

9. The connector of claim 1, further comprising:

a cable or a Flexible Printed Circuit Board (FPCB) electrically connected to the first plurality of contacts.

10. The connector of claim 1, wherein at least part of the at least one first magnet is overlapped to at least part of the at least one second magnet in view from the vertical direction when the second housing is inserted into the cavity of the first housing.

11. An electronic device comprising:

a socket configured to be coupled to an external plug, wherein the socket comprises, a cavity for accommodate the external plug; and at least one first magnet disposed within the cavity in a parallel configuration along a transverse direction perpendicular to an inserted direction in which the external plug is inserted into the cavity of the socket, wherein a pole of the at least one first magnet faces in a vertical direction perpendicular to the insertion direction and the transverse direction; and a first plurality of contacts disposed, facing in the vertical direction, on the at least one first magnet, wherein the first plurality of contacts are capable of electrically connecting with a second plurality of contacts disposed on at least one second magnet of the mating connector.

12. The electronic device of claim 11, wherein each contact in the first plurality of contacts is ring-shaped and is surrounding at least one side of the at least one magnet.

13. The electronic device of claim 11, wherein the socket is mounted on a circuit board inside the electronic device.

14. The electronic device of claim 11, wherein the external plug is configured to charge the electronic device or receive data from the electronic device.

15. A connector system comprising:

a first connector electrically and detachably connected to a second connector, wherein the first connector comprises:

a cavity configured to detachably couple to a second housing of a mating connector;

a first magnet disposed within the cavity in a parallel configuration along a transverse direction perpendicular to an inserted direction in which the second housing is inserted into the cavity of the first housing, wherein a pole of the first magnet faces in a vertical direction perpendicular to the insertion direction and the transverse direction; and a first plurality of contacts disposed, facing in the vertical direction, on the first magnet, and wherein the second connector comprises:

a plurality of second contacts disposed on a second magnet, and wherein at least part of the first magnet is overlapped to at least part of the second magnet in view from the vertical direction when the second connector is inserted into the cavity of the first connector, and the plurality of second contacts are capable of electrically connecting with the plurality of first contacts of the first connector by a magnetic force between the first magnet and the second magnet in overlapped area.

16. The connector system of claim 15, wherein the first magnet and the second magnet are bar-shaped elongated in the transverse direction.

17. The connector system of claim 16, wherein the plurality of the first contacts and the plurality of second contacts are ring-shaped and are surrounding at least one side of the first magnet and the second magnet respectively.

18. The connector system of claim 15, wherein the first magnets and the second magnets have a same pole arrangement.

19. The connector system of claim 15, wherein the first connector comprises a socket, and wherein the second connector comprises a plug.

20. The connector system of claim 15, wherein the first connector or the second connector is mounted on a circuit board, or on a surface of a housing which forms an exterior of an electronic device.

* * * * *